US009779710B2

(12) United States Patent
Yu et al.

(10) Patent No.: US 9,779,710 B2
(45) Date of Patent: Oct. 3, 2017

(54) ELECTRONIC APPARATUS AND CONTROL METHOD THEREOF

(71) Applicant: SAMSUNG ELECTRONICS CO., LTD., Suwon-si (KR)

(72) Inventors: Mi-ra Yu, Seoul (KR); Eun-seok Choi, Suwon-si (KR); Yong-wan Choi, Seongnam-si (KR); Kun-sok Kang, Yongin-si (KR); Sang-on Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/130,169

(22) Filed: Apr. 15, 2016

(65) Prior Publication Data

US 2016/0307553 A1 Oct. 20, 2016

Related U.S. Application Data

(60) Provisional application No. 62/148,989, filed on Apr. 17, 2015.

(30) Foreign Application Priority Data

Jul. 8, 2015 (KR) ..... 10-2015-0097020

(51) Int. Cl.
*G10H 3/14* (2006.01)
*G10H 1/42* (2006.01)
(Continued)

(52) U.S. Cl.
CPC ..... *G10H 3/146* (2013.01); *G10H 1/0058* (2013.01); *G10H 1/34* (2013.01); *G10H 1/42* (2013.01);
(Continued)

(58) Field of Classification Search
CPC .... G10H 3/146; G10H 1/42; G10H 2220/005; G10H 2220/066; G10H 2220/081; G10H 2220/395; G10H 2230/281
(Continued)

(56) References Cited

U.S. PATENT DOCUMENTS 7,554,026 B2 * 6/2009 de Moraes ..... G10H 1/361 84/601
8,111,241 B2 * 2/2012 Weinberg ..... G06F 3/017 345/158
2003/0076968 A1 * 4/2003 Rast ..... G11B 19/027 381/124
(Continued)

FOREIGN PATENT DOCUMENTS

JP 2010-204401 A 9/2010
JP 2013-54334 A 3/2013
(Continued)

*Primary Examiner* — David Warren
*Assistant Examiner* — Christina Schreiber
(74) *Attorney, Agent, or Firm* — Sughrue Mion, PLLC

(57) ABSTRACT

An electronic apparatus includes a plurality of pads, each of the plurality of pads including a touch sensor and an acceleration sensor, a sound output interface configured to output sounds that are set to the respective pads, a display configured to display visual feedback, and a processor configured to, in response to the touch sensor in a pad among the plurality of pads detecting a touch of the pad, and the acceleration sensor in the pad detecting an intensity of the touch that is greater than or equal to a value, determine that a beat is performed on the pad, control the sound output interface to output a sound that is set to the pad on which the beat is determined to be performed, with a magnitude corresponding to an intensity of the beat, and control the display to display the visual feedback corresponding to the beat determined to be performed.

20 Claims, 29 Drawing Sheets

(51) Int. Cl.
*G10H 1/00* (2006.01)
*G10H 1/34* (2006.01)

(52) U.S. Cl.
CPC ..... *G10H 3/143* (2013.01); *G10H 2210/125* (2013.01); *G10H 2220/005* (2013.01); *G10H 2220/066* (2013.01); *G10H 2220/081* (2013.01); *G10H 2220/395* (2013.01); *G10H 2230/281* (2013.01)

(58) Field of Classification Search
USPC ..... 84/615
See application file for complete search history.

(56) References Cited

U.S. PATENT DOCUMENTS

2008/0254824 A1* 10/2008 Moraes ..... A45F 5/00 455/556.1
2011/0043491 A1* 2/2011 Oh ..... G06F 3/0234 345/177
2013/0123014 A1* 5/2013 Ito ..... G06F 1/1626 463/37
2013/0152768 A1* 6/2013 Rapp ..... G10H 3/125 84/634
2014/0192269 A1* 7/2014 Tsurumoto ..... H04N 21/4126 348/734
2014/0221040 A1* 8/2014 De Moraes ..... A45F 5/00 455/550.1
2016/0048288 A1* 2/2016 Lee ..... G06F 3/03547 455/566

FOREIGN PATENT DOCUMENTS

KR 10-1089067 B1 12/2011
KR 10-1173400 B1 8/2012
KR 10-1433037 B1 8/2014

* cited by examiner

ELECTRONIC APPARATUS AND CONTROL METHOD THEREOF

CROSS-REFERENCE TO RELATED APPLICATIONS

This application claims priority from Korean Patent Application No. 10-2015-0097020, filed on Jul. 8, 2015 in the Korean Intellectual Property Office, which claims priority from U.S. Provisional Application No. 62/148,989, filed on Apr. 17, 2015 in the United States Patent and Trademark Office, the disclosures of which are incorporated herein by reference in their entireties.

BACKGROUND

Field

Apparatuses and methods consistent with exemplary embodiments relate to an electronic apparatus and a control method thereof, and more particularly, to an electronic apparatus detecting a beat, and providing feedback corresponding to the detected beat, and a control method thereof.

Description of the Related Art

Due to the development of electronic technology, various types of electronic products have been developed and spread. Various types of display apparatuses such as a television (TV), a portable phone, a personal computer (PC), a laptop PC, or a personal digital assistant (PDA) have been widely used in most houses. The technology for various electronic products may be used in various electronic musical instruments, and demands for such electronic musical instruments have been increased.

For example, electronic drums among the electronic musical instruments may include pads to which piezoelectric sensors are attached, and may reproduce sound by converting impacts, vibrations, and pressure transferred from the sensors into electric signals. Electronic drum sticks may include a light emitting diode (LED) and a sensor, and may reproduce percussive sound while the LED flickers in response to a tip portion thereof being beaten to a surface.

That is, the electronic musical instruments in the related art utilize the piezoelectric sensors to implement the percussion instrument, and are fabricated to respond to the impact and vibration in response to the percussion instrument being beaten using the stick. The piezoelectric sensor is more expensive than an acceleration sensor, and responds to even a micro vibration amount. The technology using the piezoelectric sensor may be disadvantageous for separately applying to individual structures. That is, the structures commonly coupled in one may be difficult to receive various inputs.

The percussion instrument may be implemented with only acceleration sensors, but data for micro vibration may also be reflected between the acceleration sensors in the coupled structures, and thus it may be difficult to determine whether or not a pad portion is accurately beaten in signal processing.

Accordingly, various methods for accurately determining whether which pad is beaten in structures coupled in one and providing feedback for the determination result are proposed.

SUMMARY

Exemplary embodiments address at least the above problems and/or disadvantages and other disadvantages not described above. Also, the exemplary embodiments are not required to overcome the disadvantages described above, and may not overcome any of the problems described above.

One or more exemplary embodiments provide an electronic apparatus determining whether or not a pad is beaten by combining an acceleration sensor signal and a touch sensor signal, and providing feedback corresponding to the determination result, and a control method thereof.

According to an aspect of an exemplary embodiment, there is provided an electronic apparatus including pads, each of the pads including a touch sensor and an acceleration sensor. The electronic apparatus further includes a sound output interface configured to output sounds that are set to the respective pads, and a display configured to display visual feedback. The electronic apparatus further includes a processor configured to, in response to the touch sensor in a pad among the pads detecting a touch of the pad, and the acceleration sensor in the pad detecting an intensity of the touch that is greater than or equal to a value, determine that a beat is performed on the pad, control the sound output interface to output a sound that is set to the pad on which the beat is determined to be performed, with a magnitude corresponding to an intensity of the beat, and control the display to display the visual feedback corresponding to the beat determined to be performed.

The processor may be further configured to detect the touch based on a change of a touch value of a touch sensor signal that is received from the touch sensor, and detect the intensity of the touch based on an acceleration value that is determined based on an acceleration sensor signal that is received from the acceleration sensor.

The processor may be further configured to determine that the beat is performed on the pad of which the touch value is ON and the acceleration value is greater than or equal to the value.

The processor may be further configured to determine that the beat is not performed on the pad of which the touch value is OFF or the acceleration value is less than the value.

The processor may be further configured to compensate the acceleration sensor signal with an offset for gravitational acceleration, and determine the acceleration value based on the compensated acceleration sensor signal.

The processor may be further configured to determine the offset for the gravitational acceleration based on a slope of the electronic apparatus.

The pads may include a first pad and a second pad, and the processor may be further configured to detect a first touch value of a first touch sensor signal that is received from a first touch sensor in the first pad, detect a first acceleration value that is determined based on a first acceleration sensor signal that is received from a first acceleration sensor in the first pad, determine that a first beat is performed on the first pad of which the first touch value is ON and the first acceleration value is greater than or equal to the value, detect a second touch value of a second touch sensor signal that is received from a second touch sensor in the second pad, detect a second acceleration value that is determined based on a second acceleration sensor signal that is received from a second acceleration sensor in the second pad, and determine that a second beat is not performed on the second pad of which the second touch value is OFF or the second acceleration value is less than the value.

The processor may be further configured to control the display to display the visual feedback at a level corresponding to the intensity of the beat determined to be performed.

The display may include a light emitting diode (LED) corresponding to the pad, and the processor may be further configured to turn on the LED corresponding to the pad on which the beat is determined to be performed, and adjust at least one among a brightness and a color of the LED based on the intensity of the beat determined to be performed.

The electronic apparatus may further include an input interface configured to receive sound content from an external source, and the processor may be further configured to mix the sound content and the sound that is set to the pad on which the beat is determined to be performed, to generate a mixed sound, and control the sound output interface to output the mixed sound.

The processor may be further configured to control the display to display the visual feedback based on information of the sound content and the intensity of the beat determined to be performed.

The electronic apparatus may further include an input interface configured to receive sound content from an external source, and the processor may be further configured to in a first mode, mix the sound content and the sound that is set to the pad on which the beat is determined to be performed, to generate a mixed sound, and control the sound output interface to output the mixed sound, and in a second mode, control the sound output interface to output the sound content other than the sound that is set to the pad on which the beat is determined to be performed.

According to an aspect of another exemplary embodiment, there is provided a method of controlling an electronic apparatus including pads, each of the pads including a touch sensor and an acceleration sensor, and a sound output interface configured to output sounds that are set to the respective pads, the method including detecting a touch of a pad among the pads through the touch sensor in the pad, detecting an intensity of the touch through the acceleration sensor in the pad, determining that a beat is performed on the pad in response to the detecting the touch and the detecting the intensity of the touch that is greater than or equal to a value, outputting a sound that is set to the pad on which the beat is determined to be performed, with a magnitude corresponding to an intensity of the beat, and displaying visual feedback corresponding to the beat determined to be performed.

The detecting the touch may include detecting the touch based on a change of a touch value of a touch sensor signal that is received from the touch sensor, and the detecting the intensity of the touch may include detecting the intensity of the touch based on an acceleration value that is determined based on an acceleration sensor signal that is received from the acceleration sensor.

The determining that the beat is performed may include determining that the beat is performed on the pad of which the touch value is ON and the acceleration value is greater than or equal to the value.

The determining that the beat is performed may include determining that the beat is not performed on the pad of which the touch value is OFF or the acceleration value is less than the value.

The method may further include compensating the acceleration sensor signal with an offset for gravitational acceleration, and determining the acceleration value based on the compensated acceleration sensor signal.

The method may further include determining the offset for the gravitational acceleration based on a slope of the electronic apparatus.

The pads may include a first pad and a second pad, and the method may further include detecting a first touch value of a first touch sensor signal that is received from a first touch sensor in the first pad, detecting a first acceleration value that is determined based on a first acceleration sensor signal that is received from a first acceleration sensor in the first pad, determining that a first beat is performed on the first pad of which the first touch value is ON and the first acceleration value is greater than or equal to the value, detecting a second touch value of a second touch sensor signal that is received from a second touch sensor in the second pad, detecting a second acceleration value that is determined based on a second acceleration sensor signal that is received from a second acceleration sensor in the second pad, and determining that a second beat is not performed on the second pad of which the second touch value is OFF or the second acceleration value is less than the value.

The displaying may include displaying the visual feedback at a level corresponding to the intensity of the beat.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
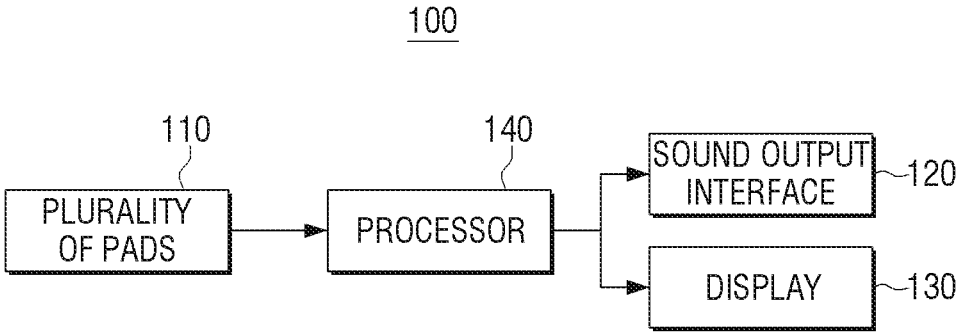
FIG. 1 is a block diagram illustrating a configuration of an electronic apparatus according to an exemplary embodiment.

Exemplary embodiments are described in greater detail with reference to the accompanying drawings.

In the following description, like drawing reference numerals are used for like elements, even in different drawings. The matters defined in the description, such as detailed construction and elements, are provided to assist in a comprehensive understanding of the exemplary embodiments. However, it is apparent that the exemplary embodiments can be practiced without those specifically defined matters. Also, well-known functions or constructions may not be described in detail because they would obscure the description with unnecessary detail.

It will be understood that the terms "comprises" and/or "comprising" used herein specify the presence of stated features or components, but do not preclude the presence or addition of one or more other features or components. In addition, the terms such as "unit", "-er (-or)", and "module" described in the specification refer to an element for performing at least one function or operation, and may be implemented in hardware, software, or the combination of hardware and software.

FIG. 1 is a block diagram illustrating a configuration of an electronic apparatus according to an exemplary embodiment.

Referring to FIG. 1, an electronic apparatus 100 includes a plurality of pads 110, a sound output interface 120, a display 130, and a processor 140.

The electronic apparatus 100 described in the disclosure may refer to an electronic apparatus that detects a user touch according to a user operation, detects an intensity of the user touch, and generates or outputs sound corresponding to the detected user touch and the detected intensity of the user touch among electronic apparatuses. The electronic apparatus 100 may be implemented with a percussive instrument such as an electronic drum or an electronic drum stick as well as a TV, a laptop PC, a tablet PC, a game console, a portable phone, a smart watch, and the like, but the electronic apparatus is not limited thereto.

Functions performed through the processor 140 of the electronic apparatus 100 according to an exemplary embodiment, which are to be described later, may be implemented with a software module form, and the implemented software module may be operated in various electronic apparatuses.

Each of the plurality of pads 110 may include a touch sensor and an acceleration sensor. The touch sensor may be a sensor that inputs an instruction displayed on a screen by pressing the screen with a fingertip. The principle of the touch sensor may include a capacitance change type, an electric conductivity change type (a resistance change type), a light amount change type, and the like. The acceleration sensors may be configured to measure dynamic force of an object such as acceleration, vibration, or impact by processing an output signal, and various types of acceleration sensors may be provided. For example, the acceleration sensor may be largely divided into an inertia type, a gyro type, and a silicon semiconductor type according to a detection method.

Figure 2A:
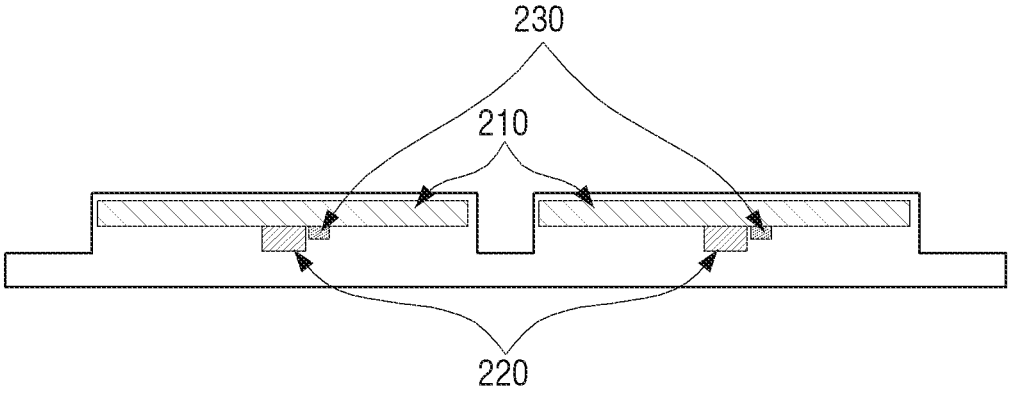
FIGS. 2A and 2B are diagrams illustrating a structure of a plurality of pads according to an exemplary embodiment.
Figure 2B:
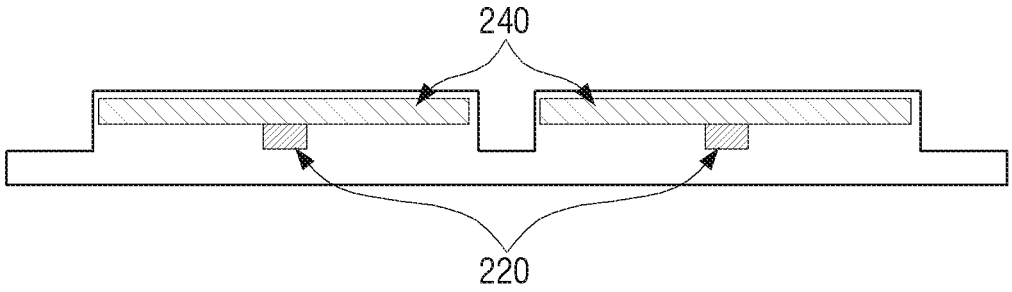

For example, the plurality of pads 110 may be implemented with structures as illustrated in FIGS. 2A and 2B.

FIGS. 2A and 2B are diagrams illustrating structures of a plurality of pads according to an exemplary embodiment.

Referring to FIG. 2A, each of the plurality of pads 110 includes a pad 210 configured to receive a user operation, an acceleration sensor 220, and a touch sensor 230, and is implemented in a structure that the acceleration sensor 220 and the touch sensor 230 are be located under the pad 210. That is, the pad 210 may include a surface or a plate to be beaten by a user. Because the acceleration sensor 220 and the touch sensor 230 are located under the pad 210, in response to the user touch being performed on the pad 210, the user touch may be detected through the touch sensor 230, and an intensity of the detected user touch may be measured through the acceleration sensor 220.

Referring to FIG. 2B, each of the plurality of pads 110 includes a touch pad 240 and the acceleration sensor 220, and is implemented in a structure that the acceleration sensor 220 is be located under the touch pad 240. That is, unlike the pad 210 of FIG. 2A, the touch pad 240 of FIG. 2B may directly detect the user touch. The touch pad 240 may be configured of multiple layers including a layer to be directly touched with a finger, a layer in which horizontal and vertical electrode rods are formed in a grid form, a coupled circuit board layer, and the like. A position in which the finger is first touched may be recorded so that a movement of the finger is continuously detected, and the layer in which the electrode rods are located may be charged by an AC current. In response to the finger being close to the electrode rod grid, the current may be interrupted. The current interruption may be detected through the circuit board, and thus the user touch may be detected.

Referring again to FIG. 1, the sound output interface 120 may output a plurality of sounds set according to the plurality of pads 110. Among the plurality of pads, the sound set to a first pad and the sound set to a second pad may be the same as each other or may be different from each other. For example, the sound set to the first pad may be set to sound corresponding to a lower range of a low- and middle-pitched tone, and the sound set to the second pad may be set to sound corresponding to a higher range of a high-pitched tone.

The sound output interface 120 may output the sounds set to the plurality of pads 110, which are corresponding to user touches detected through the plurality of pads 110.

The display 130 may provide visual feedback. For example, the display 130 may display text, a number, an image, and the like. The display 130 may display images having preset patterns corresponding to the user touches detected through the plurality of pads 110.

In this example, the display 130 may be implemented with a liquid crystal display (LCD), an organic LED (OLED), a plasma display panel (PDP), and the like.

The display 130 may be defined to include the LED provided in the electronic apparatus 100. Similarly, the LED may emit light according to the user touches detected through the plurality of pads 110. Detailed description thereof will be made later.

The processor 140 may determine that a beat is performed on at least one among the plurality of pads 110 in response to the user touch being detected by the touch sensor of the at least one pad and being determined that the intensity of the user touch detected through the acceleration sensor is more than or equal to a preset threshold value.

That is, on the assumption that the user touch is detected through the touch sensor included in a first pad among the plurality of pads 110, the processor 140 may determine that the beat for the first pad is performed only in response to the intensity of the user touch measured through the acceleration sensor included in the first pad being more than or equal to the preset threshold value. The processor 140 may equally perform the determination process on a second pad, a third pad, . . . , and the like included in the plurality of pads 110.

Accordingly, the processor 140 may determine whether or not the beat for the at least one pad among the plurality of pads 110 is performed based on a combination of an acceleration sensor signal and a touch sensor signal. That is, the processor 140 may determine that the beat on the corresponding pad is performed in response to a value processed for the acceleration sensor value being more than or equal to the preset threshold value, and a touch value in a corresponding section range being changed from OFF to ON. Detailed description thereof will be made with reference to FIG. 3.

Figure 3:
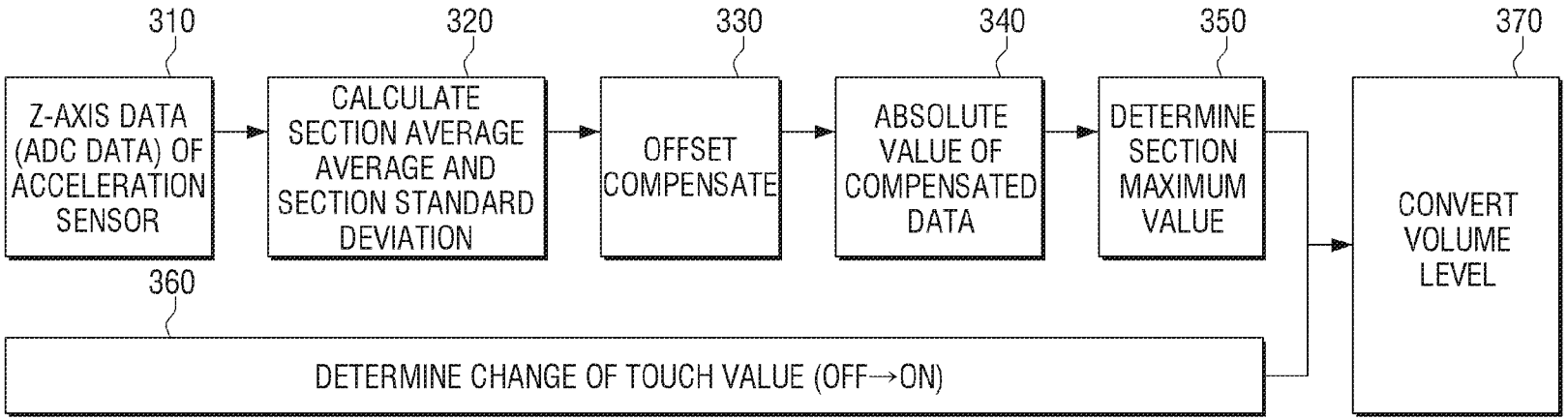
FIG. 3 is a diagram illustrating a process of determining a beat according to an exemplary embodiment.

FIG. 3 is a diagram illustrating a beat determination process according to an exemplary embodiment.

Referring to FIG. 3, the processor 140 may detect the user touch based on change of a touch value corresponding to the touch sensor signal, and detect the intensity of the user touch based on the acceleration value calculated from the acceleration sensor signal.

For example, the processor 140 may detect a Z-axis data (ADC Data) of the acceleration sensor signal (310), and calculate an offset for calculating a section average and a section standard deviation according to a preset section with respect to the detected Z-axis data (320).

Because the acceleration sensor outputs a value to which an effect of gravitational acceleration is reflected, the acceleration sensor signal on the effect of the gravitational acceleration may be compensated. The processor 140 may determine a section having no movement, that is, a section in which the user touch is not detected with respect to the at least one pad among the plurality of pads, calculate the section average and the section standard deviation during the corresponding section, and calculate the offset based on the calculated section average and section standard deviation.

The processor 140 may compensate the offset for reflecting the calculated offset to the acceleration sensor signal (330). That is, the processor 140 may acquire the acceleration sensor signal from which the offset, that is, the effect of the gravitational acceleration, is removed by removing the calculated offset from the acceleration sensor signal based on the calculated section average and section standard deviation.

The processor 140 may calculate an acceleration value by converting the offset-compensated acceleration sensor signal or compensated data to an absolute value (340).

The processor 140 may determine a maximum value for a section from the calculated acceleration value (350).

The processor 140 may detect the user touch by determining whether or not the touch value corresponding to the touch sensor signal is changed (360) while the process for calculating the offset from the acceleration sensor signal, reflecting the calculated offset to the acceleration sensor signal, calculating the acceleration value by converting the offset-compensated acceleration sensor signal to the absolute value, and determining the maximum value based on the calculated acceleration value. For example, the processor 140 may detect the user touch by determining whether or not the touch value corresponding to the touch sensor signal is changed from OFF to ON.

The processor 140 may determine that the beat for the corresponding pad is performed in response to the user touch being detected and the calculated acceleration value being more than or equal to the preset threshold value, and thus the processor 140 may convert the maximum value for a section to a volume level corresponding thereto (370).

The process of determining whether or not the beat on the pad is performed based on the acceleration sensor signal and the touch sensor signal through the processor 140 will be described in detail through a graph.

Figure 4:
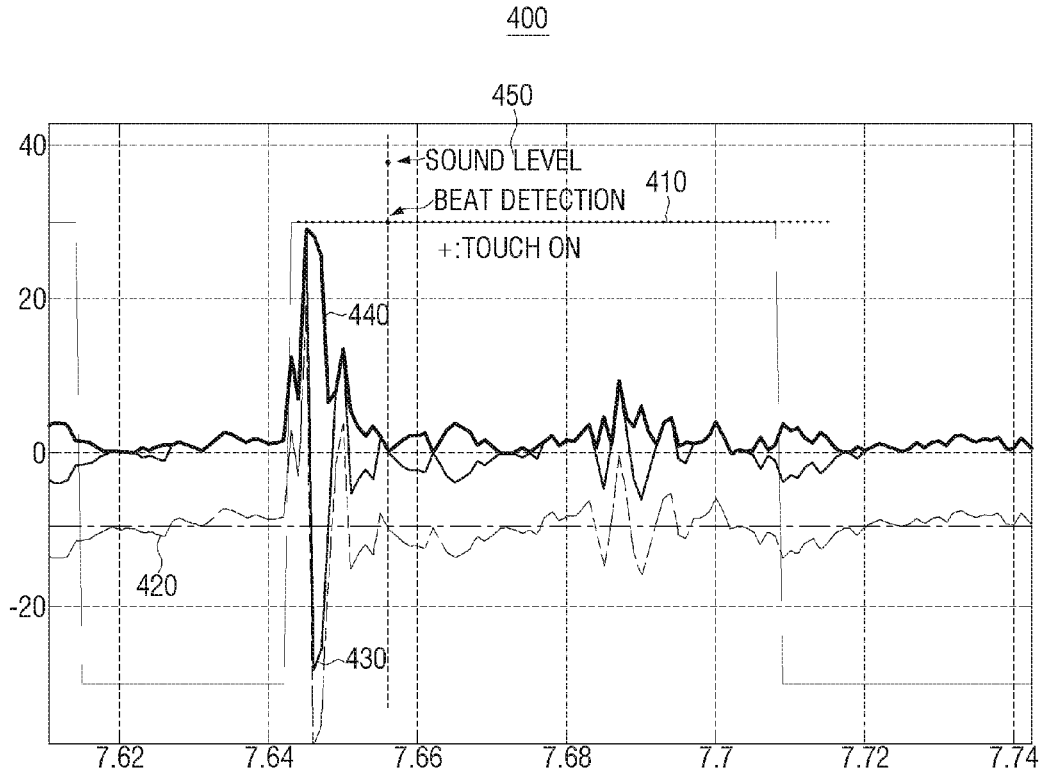
FIG. 4 is a graph illustrating an acceleration sensor signal and a touch sensor signal according to an exemplary embodiment.

FIG. 4 is a graph illustrating an acceleration sensor signal and a touch sensor signal according to an exemplary embodiment.

FIG. 4 illustrates an acceleration sensor signal and a touch sensor signal currently detected through an acceleration sensor and a touch sensor provided in one pad.

In FIG. 4, an X-axis of the graph indicates time, and a Y-axis indicates an intensity of a signal.

For example, a touch sensor signal 410, an actual acceleration sensor signal 420, an actual acceleration sensor signal 430 to which an offset is reflected, an absolute value 440 of the actual acceleration sensor signal to which the offset is reflected, and a sound level 450 are illustrated in FIG. 4.

In this example, because the touch sensor signal 410 has a constant value that is not 0 (zero), the processor 140 may determine that the touch value is changed from OFF to ON, and detect the user touch.

The actual acceleration sensor signal 420 may be a signal to which the user touch and the effect of the gravitational acceleration are reflected. The processor 140 may calculate a section average and a section standard deviation for the actual acceleration sensor signal 420 according to a preset section, determine a section having no movement, and calculate an offset for the gravitational acceleration based on the section average and the section standard deviation for the corresponding section.

The processor 140 may detect the actual acceleration sensor signal 430, to which the offset is reflected, by removing the calculated offset from the actual acceleration sensor signal 420. Subsequently, the processor 140 may convert the actual acceleration sensor signal 430 to which the offset is reflected to an absolute value, and calculate an acceleration value by calculating the absolute value 440 of the actual acceleration sensor signal to which the offset is reflected.

The processor 140 may determine that a beat on a pad, of which a touch value is ON and an acceleration value is more than or equal to the preset threshold value among the plurality of pads, is performed. Referring to FIG. 4, the processor 140 may detect the user touch by determining that the touch value of the touch sensor signal 410 is changed from OFF to ON, and determine that the beat on the corresponding pad is performed in response to being determined that the absolute value 440 of the actual acceleration sensor signal to which the offset is reflected, that is, the acceleration value, is more than or equal to the preset threshold value.

The processor 140 may detect the maximum value of the acceleration value within a section, which is determined that the beat is performed, convert the detected maximum value to the sound level 450 corresponding to the maximum value, and output a sound having the sound level 450 through the sound output interface 120.

The processor 140 may determine that the beat on a pad, of which the touch value is OFF or the acceleration value is less than the preset threshold value among the plurality of pads, is not performed.

That is, in FIG. 4, the processor 140 may determine that the beat on the corresponding pad is not performed in a section that the touch sensor signal 410 has a 0 (zero) other than a constant value or a section that the acceleration value is less than the preset threshold value even in response to the touch sensor value 410 having a constant value and the acceleration value being presented.

The plurality of pads 110 may include a first pad and a second pad, and the processor 140 may determine whether or not the beats on the first pad and the second pad are performed. For example, the processor 140 may determine that the beat on the first pad is performed in response to a first touch value detected through the first pad being ON and a first acceleration value detected through the first pad being more than or equal to the preset threshold value, and determine the intensity of the user touch based on the first acceleration value. The processor 140 may determine that the beat on the second pad is not performed in response to a second touch value detected through the second pad being OFF or a second acceleration value detected through the second pad being less than the preset threshold value. The touch sensor signals and the acceleration sensor signals detected through the first pad and the second pad may be represented as in FIG. 4, and the processor 140 may determine whether or not the beat on the first pad is performed based on the touch sensor signal and the acceleration sensor signal detected through the first pad, and determine whether or not the beat on the second pad is performed based on the touch sensor signal and the acceleration sensor signal detected through the second pad. Detailed description thereof will be made later.

The processor 140 may compensate the offset for the gravitational acceleration with the acceleration sensor signal, and calculate the acceleration value based on the offset-compensated acceleration sensor signal. As described above, because the acceleration sensor outputs the value to which the effect of the gravitational acceleration is reflected, the effect of the gravitational acceleration needs to be compensated. Accordingly, the processor 140 may calculate the offset for determining the section average and the section standard deviation for the acceleration sensor signal in the section having no movement, that is, the section in which the user touch is not detected.

The offset for the gravitational acceleration may be changed according to the slope of the electronic apparatus 100. The effect of the gravitational acceleration on the electronic apparatus 100 may be changed according to the slope of the electronic apparatus 100. The effect of the gravitational acceleration on the electronic apparatus 100 will be described in detail with reference to FIGS. 5A and 5B.

Figure 5A:
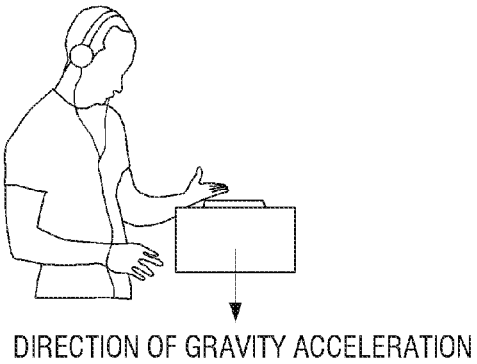
FIGS. 5A and 5B are diagrams illustrating an offset for a gravitational acceleration according to an exemplary embodiment.
Figure 5A:
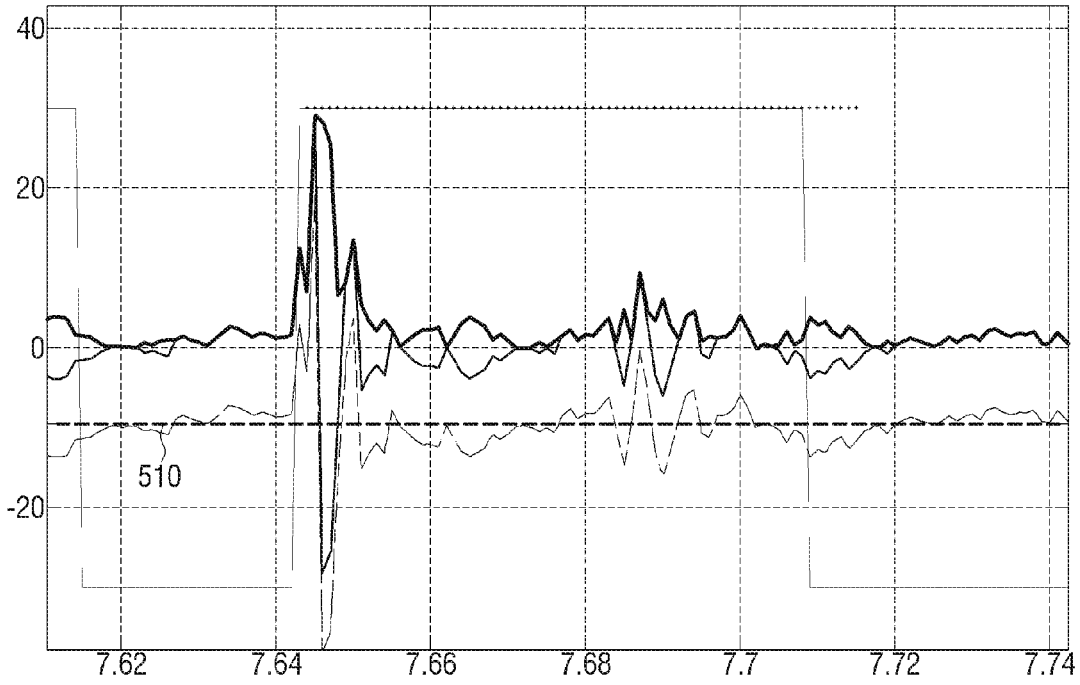
Figure 5B:
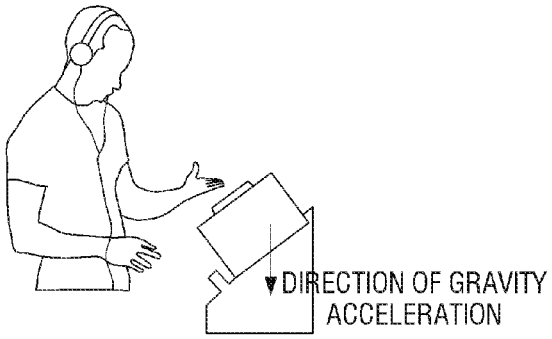
Figure 5B:
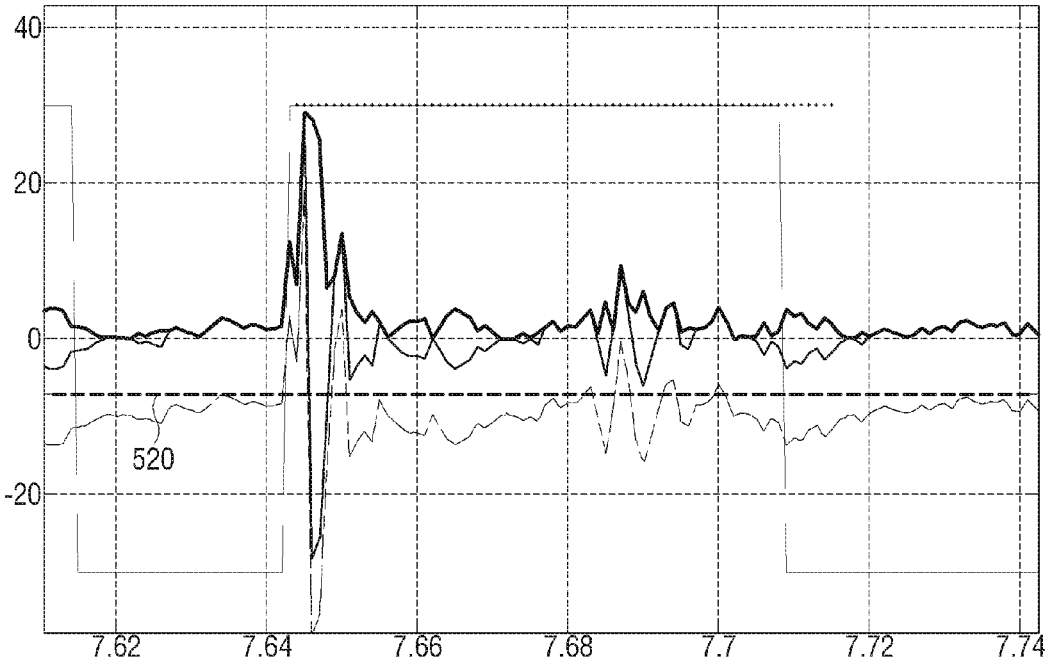

FIGS. 5A and 5B are diagrams illustrating an offset for a gravitational acceleration according to an exemplary embodiment.

Referring to FIG. 5A, in response to one of the plurality of pads 110 in the electronic apparatus 100 being beaten by the user in a state that the electronic apparatus 100 is horizontally placed on a ground, the touch sensor signal and the acceleration sensor signal detected through the touch sensor and the acceleration sensor are illustrated.

As described above, the processor 140 may calculate the offset for determining the section average and the section standard deviation of the acceleration sensor signal in the section having no movement, that is, the section that the user touch is not detected. A calculated offset 510 is illustrated in FIG. 5A.

For example, in response to the electronic apparatus 100 being horizontally located on the ground, a direction of the gravitational acceleration is a direction perpendicular to the plurality of pads 110 provided in the electronic apparatus 100. Thus, the acceleration sensor may output the value to which both the value by the user touch and the effect by the gravitational acceleration are reflected, and the effect by the gravitational acceleration may refer to an effect by 9.8 m/s. That is, by the state that the electronic apparatus 100 is horizontally placed on the ground, the effect by the gravitational acceleration (9.8 m/s) may intactly affect the acceleration sensor.

Accordingly, the offset 510 illustrated in FIG. 5A may refer to the effect by the gravitational acceleration (9.8 m/s), and the offset value is similar to the gravitational acceleration (9.8 m/s).

Referring to FIG. 5B, in response to one of the plurality of pads 110 in the electronic apparatus 100 being beaten by the user in a state that the electronic apparatus 100 is obliquely placed at a slope angle with respect to a ground, the touch sensor signal and the acceleration sensor signal detected through the touch sensor and the acceleration sensor are illustrated.

Similarly, the processor 140 may calculate the offset for determining the section average and the section standard deviation of the acceleration sensor signal in the section having no movement, that is, the section that the user touch is not detected. A calculated offset 520 is illustrated in FIG. 5B.

For example, the effect of the gravitational acceleration on the electronic apparatus 100 in a state that the electronic apparatus 100 is obliquely located at a slope angle a with respect to the ground may be gravitational acceleration*COS(a). Accordingly, the acceleration sensor may output the value to which both the value by the user touch and gravitational acceleration*COS(a) are reflected. This may indicate that the acceleration sensor may output a sum of the value by the user touch and 9.8 m/s*COS(a).

Accordingly, the offset 520 illustrated in FIG. 5B may refer to the value of gravitational acceleration*COS(a). Because the value of COS(a) does not exceed 1, the offset 520 may have a relatively small value as compared with the offset 510 of FIG. 5A.

As the slope angle is increased, the effect of the gravitational acceleration on the acceleration sensor may be reduced, and thus the offset value may also be reduced. As the electronic apparatus is placed close to the horizontal direction with respect to the ground, that is, as the slope angle is reduced, the effect of the gravitational acceleration on the acceleration sensor may be increased, and thus the offset value may also be increased.

The processor 140 may acquire the offset-compensated acceleration sensor signal by removing the offset 510 and 520 illustrated in FIGS. 5A and 5B from the actual acceleration sensor signal.

For example, the processor 140 may perform the offset calculation process in a starting stage that the electronic apparatus 100 is turned on and driven. In this example, in response to the electronic apparatus 100 being turned on by a user operation, the processor 140 may calculate the offset according to the slope of the electronic apparatus 100 by calculating the section average and the section standard deviation for the acceleration sensor signal acquired through the acceleration sensor. That is, in response to the acceleration sensor signal being acquired by the user touch detected after the electronic apparatus 100 determines the offset for previously automatically calculating the offset in an initial state that the electronic apparatus 100 is turned on, the processor 140 may reflect the previous determined offset to the acquired acceleration sensor signal.

In another example, in response to a command for allowing a setup function or a normalizing function to be performed being input by the user operation, the processor 140 may calculate the offset according to the slope of the electronic apparatus 100 by calculating the section average and the section standard deviation for the acceleration sensor signal acquired through the acceleration sensor. That is, in response to the command for allowing the setup function or the normalizing function to be performed being input according to the user operation, the processor 140 may manually calculate the offset.

The processor 140 may detect the user touch based on change of the touch value corresponding to the touch sensor signal. For example, the processor 140 may determine that the user touch on at least one among the plurality of pads 110 is detected only in response to the touch value being changed from OFF to ON. The touch sensor signal will be described in detail with reference to FIGS. 6A and 6B.

Figure 6A:
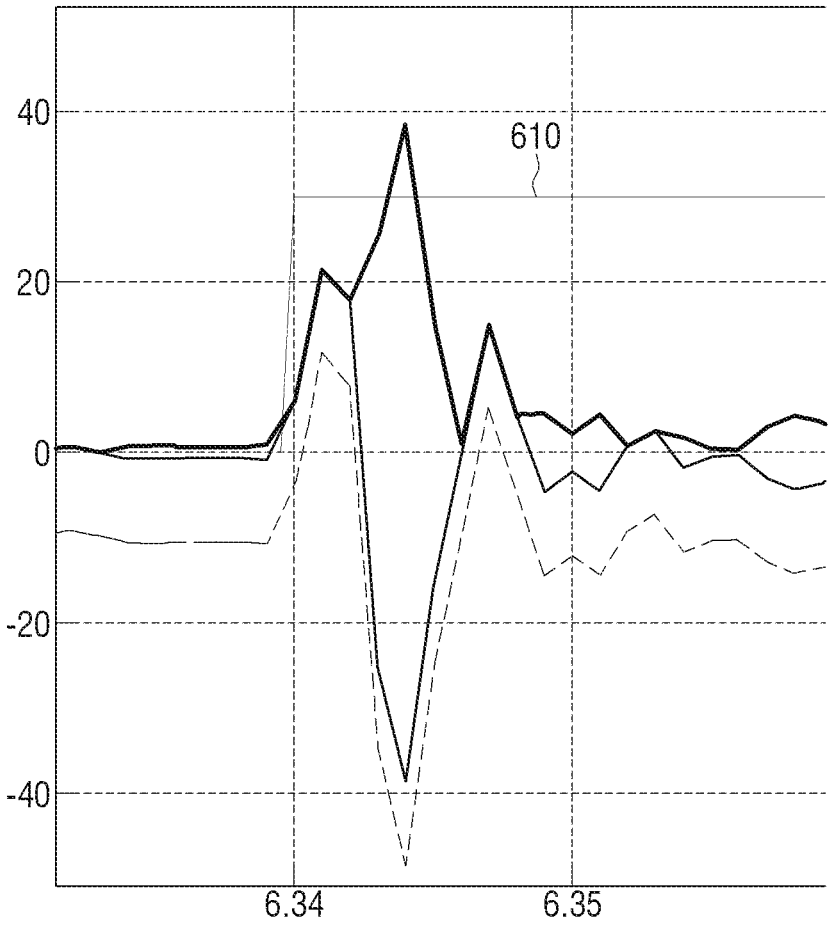
FIGS. 6A and 6B are graphs illustrating a change of a touch value according to an exemplary embodiment.
Figure 6B:
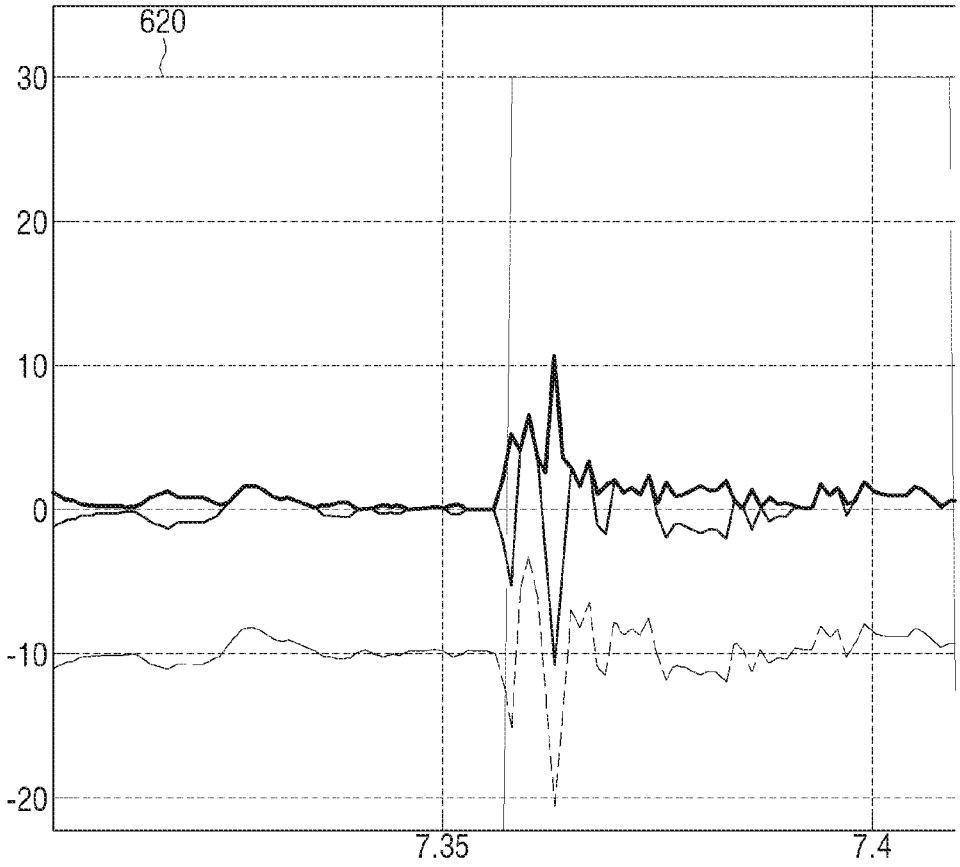

FIGS. 6A and 6B are graphs illustrating a change of a touch value according to an exemplary embodiment.

Referring to FIG. 6A, a touch sensor signal 610 is illustrated, and it can be seen that the touch sensor signal 610 is changed to a value in a range of from 0 (zero) to about 30.

For example, the touch value of the touch sensor signal 610 may be changed from OFF (a section that the touch value is 0 (zero)) to ON (a section that the touch value has a constant value). The processor 140 may determine that the user touch on the at least one pad among the plurality of pads 110 is detected in response to the touch value being changed from OFF to ON.

In another example, the processor 140 may determine that the beat on at least one pad among the plurality of pads 110 is not performed in response to a state that the touch is OFF or ON being maintained for a time or more.

That is, because the user touch is not naturally detected in response to the state that the touch value is OFF being maintained for the time or more, the processor 140 may determine that the beat on the at least one pad among the plurality of pads 110 is not performed.

The state that the touch value is maintained to ON for the time or more may refer to a state that the user intactly keeps a contact of a hand with the at least one pad among the plurality of pads 110. Therefore, in response to the state that the touch value is ON being maintained for the time or more, the processor 140 may determine that the beat on the corresponding pad is not performed even in the response to the user touch is detected. That is, the processor 140 may determine that the beat intended by the user is not performed in response to the state that the touch value is ON for the time or more being maintained.

Referring to FIG. 6B, a touch sensor signal 620 is illustrated, and it can be seen that the touch sensor signal 620 continuously has a constant value throughout a detection process. The state that the touch sensor signal 620 continuously has the constant value may refer to a state that the touch value is maintained to ON for the time or more. In this state, the processor 140 may determine that the beat on the corresponding pad is not performed even in response to the user touch being detected.

FIGS. 7, 8, 9, 10, 11, and 12 are graphs illustrating types of an acceleration sensor signal and a touch sensor signal according to a status according to one or more exemplary embodiments.

[In Response to Pad being not Beaten by User]

Figure 7:
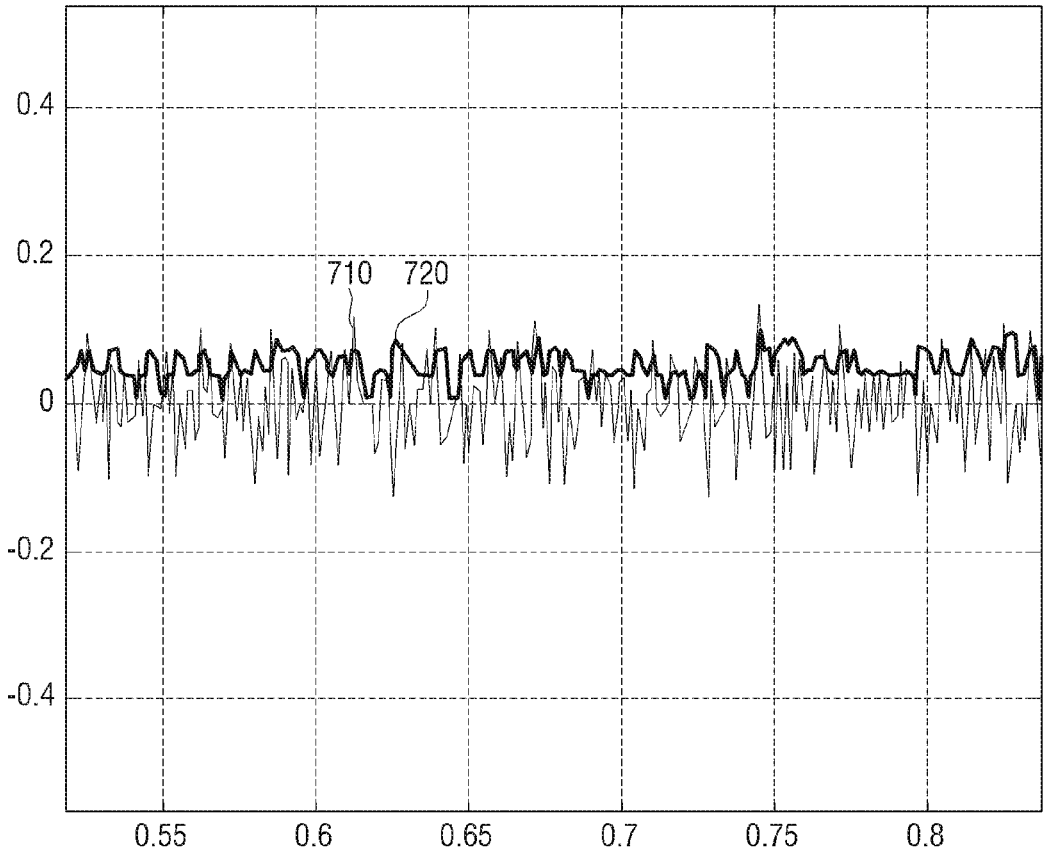
FIGS. 7, 8, 9, 10, 11, and 12 are graphs illustrating types of an acceleration sensor signal and a touch sensor signal according to a status according to one or more exemplary embodiments.

FIG. 7 illustrates the types of the acceleration sensor signal and the touch sensor signal in response to any impact being not given to the electronic apparatus 100, for example, in response to a beat, shaking, an echo of a surrounding environment, and the like being not provided to the electronic apparatus 100.

That is, in response to an acceleration value of the acceleration sensor signal being less than the preset threshold value regardless of the user touch for the first pad among the plurality of pads 110, that is, the acceleration sensor signal being changed within a range of below the preset threshold value, the processor 140 may determine the change of the acceleration sensor signal as noise generated in the acceleration sensor itself.

Referring to FIG. 7, a first graph 710 refers to a value from which an offset for the gravitational acceleration is removed from a Z-axis signal of an acceleration sensor, and a second graph 720 refers to a section standard deviation of the Z-axis signal of the acceleration sensor.

For example, in response to a magnitude of the first graph 710 being less than or equal to 0.2 in a state that an impulse is not detected through the acceleration sensor, the processor 140 may determine that a beat for the first pad is not performed by determining the value of the first graph as noise generated in the acceleration sensor itself. The reference Value for noise determination may be other values other than 0.2, and the reference value may be increased or reduced according to accuracy of the acceleration sensor.

Accordingly, even in response to the user touch being detected in the processor 140 through the change of the touch value of the touch sensor signal from OFF to ON, the processor 140 may determine the acceleration value as the noise generated in the acceleration sensor itself, and determine that the beat for the corresponding pad is not performed in response to the acceleration value of the acceleration sensor signal being less than the reference value for noise determination.

[In Response to Pad being Beaten by User]

In response to any one pad being beaten by the user, the acceleration value of the acceleration sensor signal and the touch value of the touch sensor signal are changed. The processor 140 may determine whether the beat is performed on which pad or determine whether the beat is performed with which intensity by analyzing a combination of the acceleration value and the touch value.

Figure 8:
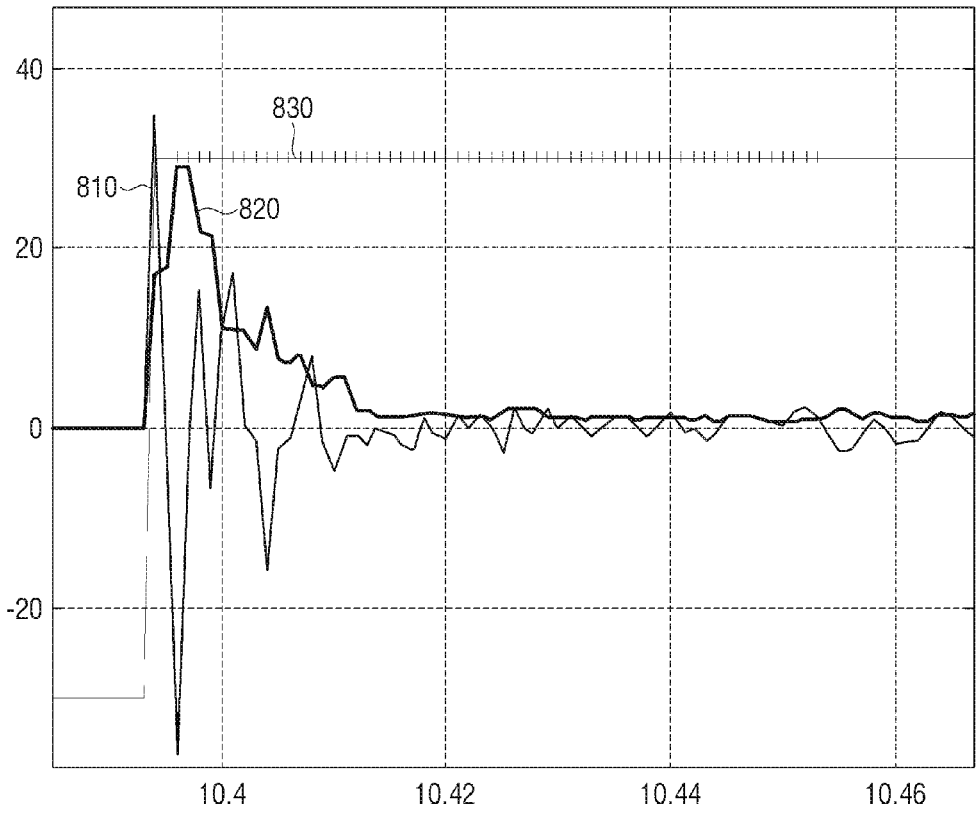

Referring to FIG. 8, a first graph 810 refers to a Z-axis signal of an acceleration sensor, a second graph 820 refers to a section standard deviation, and a third graph 830 refers to a touch sensor signal.

As described in FIG. 4, the first graph 810 illustrated in FIG. 8 may correspond to the actual acceleration sensor signal 430 to which the offset is reflected illustrated in FIG. 4, and the third graph 830 illustrated in FIG. 8 may refer to the touch sensor signal 410 illustrated in FIG. 4.

That is, the processor 140 may detect that the user touch on a corresponding pad is presented because the third graph 830 is changed from OFF to ON. The processor 140 may determine that the beat on the corresponding pad is performed in response to being detected that the acceleration value of the first graph 810 is more than or equal to the preset threshold value.

The processor 140 may determine the intensity of the user touch, that is, the beat intensity based on the acceleration value of the first graph 810.

The detailed process for determining whether or not the beat on the corresponding pad is performed in the processor 140 has been previously described in FIG. 4, and thus detailed description thereof will be omitted.

[In Response to Pad being Continuously Beaten by User]

Figure 9:
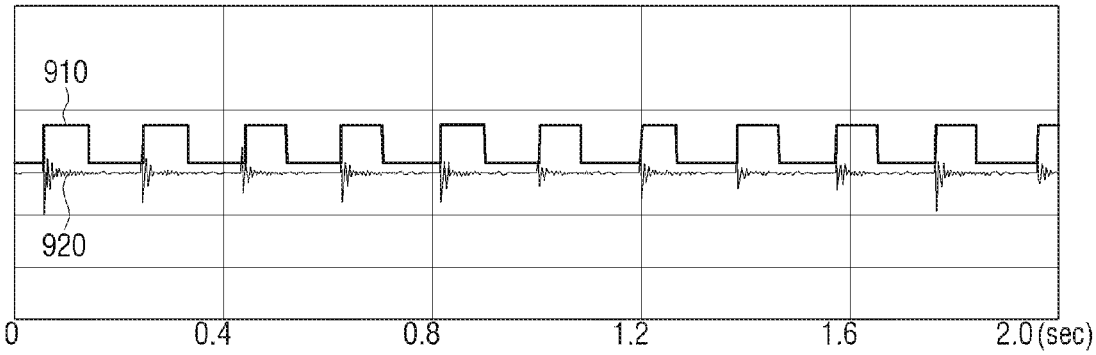

FIG. 9 illustrates an acceleration sensor signal and a touch sensor signal in response to the pad being continuously beaten by the user.

A first graph 910 refers to a touch sensor signal, and a second graph 920 refers to an acceleration sensor signal. For example, the second graph 920 currently illustrated in FIG. 9 may refer to an acceleration sensor signal from which the offset for the gravitational acceleration is not removed.

In response to the pad being continuously beaten by the user, a section in which the user touch for the corresponding pad is changed from OFF to ON as the first graph 910 illustrated in FIG. 9 is continuously indicated, and thus the processor 140 may continuously determine that the user touch is detected and then is not detected.

The second graph 920 indicates that the acceleration value of the preset threshold value or more is continuously presented, and thus the processor 140 may determine that the beat on the corresponding pad is continuously performed through repetitive detection of the state that the acceleration value in the section that the user touch is detected is more than or equal to the preset threshold value.

That is, because the section that the user touch is detected and the section that the acceleration value is more than or equal to the preset threshold value are identical with each other and are repeatedly presented in FIG. 9, the processor 140 may determine that the continuous beat on the corresponding pad is performed. However, in response to the section that the user touch is detected and the section that the acceleration value is more than or equal to the preset threshold value being repeatedly presented in a state that two sections are not identical with each other, the processor 140 may determine that the continuous beat on the corresponding pad is not performed.

[In Response to Other Portion Other than Pad being Beaten or Shaking being Generated]

Because the plurality of pads 110 are attached to the electronic apparatus 100, the impact on the electronic apparatus 100 may be transferred to acceleration sensors provided in the plurality of pads. For example, in response to the other portion other than the pad being beaten by the user, the acceleration sensor may output an acceleration sensor signal to which the impact for other portion is reflected. In this example, the processor 140 may determine whether or not the acceleration sensor signal is an acceleration sensor signal generated by beating the corresponding pad based on the touch value of the touch sensor signal. The other portion other than the pad may include other pads.

For example, the plurality of pads 110 may include a first pad and a second pad. In response to the second pad other than the first pad being beaten by the user, the processor 140 may detect an acceleration sensor signal output from a first acceleration sensor provided in the first pad, but the acceleration sensor signal output from the first acceleration sensor may be a signal to which the impact due to beating on the second pad is reflected. In response to a touch value of a touch sensor signal being an OFF state based on the touch sensor signal output from a first touch sensor provided in the first pad, the processor 140 may determine the current acceleration sensor signal as not the signal output due to the beating of the first pad but the signal to which the effect due to the beating of the second is reflected.

That is, even in response to the acceleration sensor signal output from the first acceleration sensor provided in the first pad being detected, the processor 140 may determine not that the beat for the first pad is performed but that the beat for other pad or other region of the electronic apparatus 100 is performed in response to the touch sensor signal output from the first touch sensor provided in the first pad being an OFF state or the touch sensor signal being maintained to an ON state for a preset time. Accordingly, the processor 140 may determine that the beat on the first pad is performed only in response to the acceleration sensor signal output from the first acceleration sensor provided in the first pad being detected and the touch sensor signal output from the first touch sensor provided in the first pad being changed from OFF to ON.

Accordingly, the processor 140 may accurately determine that the beat is performed on which pad through a combination of the touch sensor signal and the acceleration sensor signal.

Figure 10:
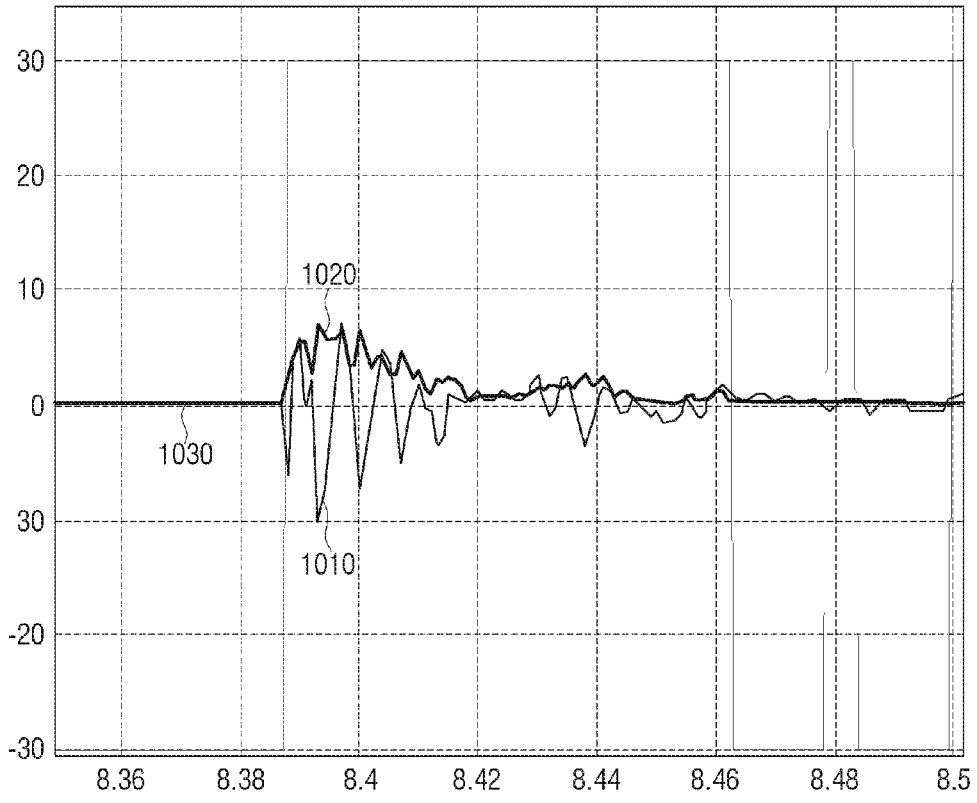

Referring to FIG. 10, a first graph 1010 refers to a Z-axis signal of an acceleration sensor, a second graph 1020 refers to a section standard deviation, and a third graph 1030 refers to a touch sensor signal.

It can be seen that in response to the beat on other portion other than the corresponding pad being performed or the shaking of the electronic apparatus being generated, the Z-axis signal of the acceleration sensor reflects the beat generated in other portion or the shaking as in the graph 1010, but a touch value of the third graph 1030 is 0 (zero).

Even in response to the first graph 1010 representing that the impact is reflected to the acceleration value, because the touch value of the third graph 1030 is 0 (zero), the processor 140 may determine that even the user touch on the corresponding pad is not performed, and thus determine that the beat on the corresponding pad is not also performed.

Through the above-described determination process, the process 140 may accurately determine whether the beat is performed on which pad even in response to the plurality of pads 110 including a first pad, a second pad, a third pad, and the like, and determine whether the acceleration value of the acceleration sensor signal corresponding to each pad is a value to which the beat performed on the corresponding pad is reflected or a value to which the beat performed on other pad is reflected.

Figure 11:
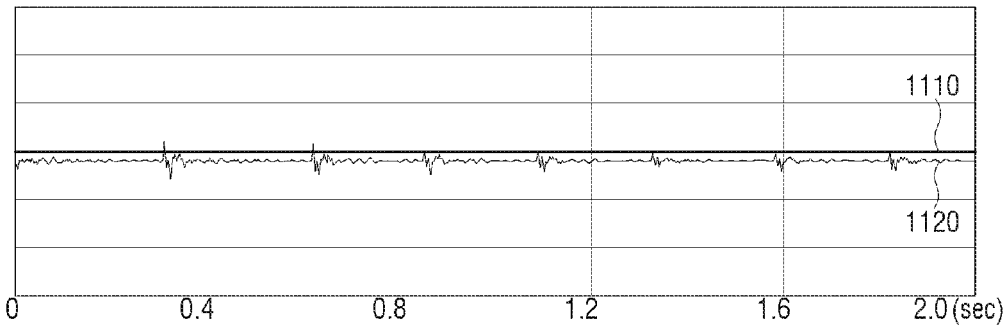
Figure 12:
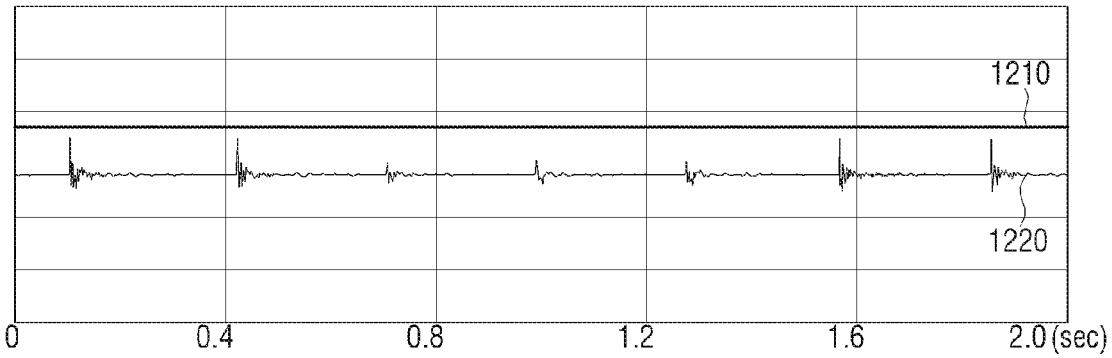

FIGS. 11 and 12 illustrate an acceleration sensor signal and a touch sensor signal of a first pad detected through the processor 140 in response to a second pad being beaten by the user out of the first pad and the second pad of the plurality of pads 110.

As described in FIG. 10, in FIG. 11, a first graph 1110 refers to the touch sensor signal, and a second graph 1120 refers to the acceleration sensor signal. The second graph 1120 represents a value to which an effect of the beating of the user on the second pad is reflected, and the first graph 1110 represents that the touch value due to the user touch is not changed because the beating of the user is not performed on the first pad.

Accordingly, even in response to the value corresponding to the beating being indicated in the second graph 1120, the processor 140 may determine that the beat not on the first pad but the second pad is performed based on the first graph 1110 indicating that the touch value is completely not changed and is maintained as 0 (zero).

Referring to FIG. 12, a first graph 1210 refers to the touch sensor signal, and a second graph 1220 refers to the acceleration sensor signal. The first graph 1120 indicates that the touch value has a constant value and the touch value is an ON state. The second graph 1220 indicates the acceleration value to which the beating of the user is reflected.

The touch value of the first graph 1210 may continuously maintain the ON state without change from OFF to ON, and thus the processor 140 may determine that the beat on the first pad among the plurality of pads 110 is not performed even in response to the user touch on the first pad being detected. That is, as described in FIG. 6B, the state that the touch value is maintained to the ON state for a time or more may refer to a state that the user intactly keeps a contact of a hand with the first pad. Therefore, in response to the state that the touch value is the ON state being maintained for the time or more, the processor 140 may determine that the beat on the first pad is not performed even in the response to the user touch is detected.

Accordingly, the processor 140 may determine that the user touch for the first pad is detected but the beat for the first pad is not performed, and thus the processor 140 may determine that the acceleration value to which the beating is reflected in the graph 1220 is acquired by the beat performed on the second pad.

Accordingly, the processor 140 may determine that the beat is performed not on the first pad but on the second pad.

Figure 13:
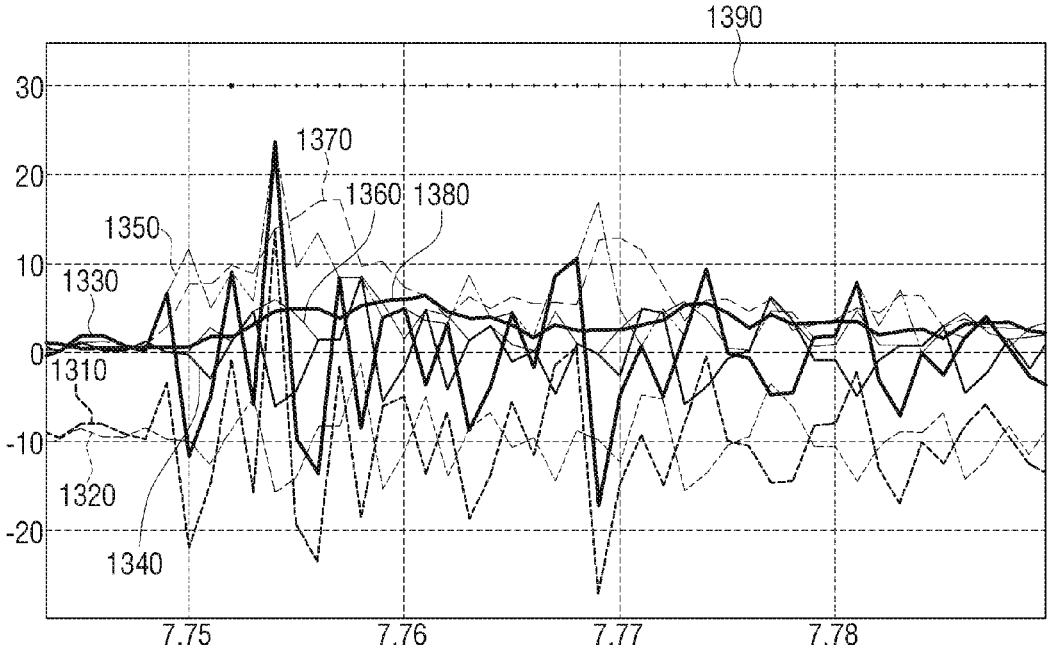
FIG. 13 is a graph illustrating a touch sensor signal and an acceleration sensor signal of each pad detected in response to a beat being performed through a first pad and a second pad according to an exemplary embodiment.

FIG. 13 is a graph illustrating an acceleration sensor signal and a touch sensor signal of each pad detected in response to beats being performed through a first pad and a second pad according to an exemplary embodiment.

Referring to FIG. 13, a first graph 1310, a second graph 1330, a third graph 1350, and a fourth graph 1370 refer to data of the acceleration sensor for the first pad, and a fifth graph 1320, a sixth graph 1340, a seventh graph 1360, and an eighth graph 1380 refer to data of the acceleration sensor for the second pad.

For example, the first graph 1310 may refer to an actual acceleration sensor signal of the first pad, the second graph 1330 may refer to an offset-compensated acceleration sensor signal of the first pad, the third graph 1350 may refer to an absolute value of the offset-compensated acceleration sensor signal of the first pad, and the fourth graph 1370 may refer to a section standard deviation of the actual acceleration sensor signal of the first pad.

The fifth graph 1320 may refer to an actual acceleration sensor signal of the second pad, the sixth graph 1340 may refer to an offset-compensated acceleration sensor signal of the second pad, the sixth graph 1360 may refer to an absolute value of the offset-compensated acceleration sensor signal of the second pad, and the eighth graph 1380 may refer to a section standard deviation of the actual acceleration sensor signal of the second pad.

A ninth graph 1390 refers to a touch sensor signal. In FIG. 13, the ninth graph 1390 simultaneously represents touch sensor signals of the first pad and the second pad, but the touch sensor signals for the first pad and the second pad may be differently represented.

The touch sensor signal of the ninth graph 1390 has a constant value not 0 (zero), and thus the processor 140 may determine that the touch value is changed from OFF to ON, and detect the user touches for the first pad and the second pad.

The first graph 1310 and the fifth graph 1320 may be signals to which both the user touch and the gravitational acceleration are reflected, and thus the processor 140 may calculate section averages and section standard deviations according to a preset section with respect to the first graph 1310 and the fifth graph 1320, and calculate offsets by the gravitational acceleration based on the section averages and the section standard deviations in the corresponding section by determining a section having no movement.

The fourth graph 1370 and the eighth graph 1380 represent the section standard deviations for the first graph 1310 and the fifth graph 1320, respectively.

The processor 140 may calculate the offsets by the gravitational acceleration based on the section standard deviations of the fourth graph 1370 and the eighth graph 1380.

The processor 140 may compensate the calculated offsets by the gravitational acceleration with respect to the first graph 1310 and the fifth graph 1320.

That is, the processor 160 may detect the second graph 1330 and the sixth graph 1340 by compensating the offsets on the first graph 1310 and the fifth graph 1320, respectively. The processor 140 may acquire the third graph 1350 and the seventh graph 1360 by converting the offset-compensated acceleration sensor signals in the second graph 1330 and the sixth graph 1340 to absolute values, and calculate the acceleration values from the acquired third graph 1350 and seventh graph 1360.

The processor 140 may detect the user touch based on the conversion of the touch value for the first pad from OFF to ON, and determine that the beat on the first pad is performed in response to the acceleration value for the first pad being more than or equal to the preset threshold value.

The processor 140 may detect the user touch based on the conversion of the touch value for the second pad from OFF to ON, and determine that the beat on the second pad is performed in response to the acceleration value for the second pad being more than or equal to the preset threshold value.

The processor 140 may determine whether or not the beats on the first pad and the second pad are performed based on the plurality of acceleration sensor signals and the touch sensor signals simultaneously multiply input through the first pad and the second pad.

The processor 140 may control the sound output interface 120 to output a sound of a type set with respect to the beat-detected pad with a magnitude corresponding to the intensity of the beat, and control the display 130 to provide visual feedback corresponding to the beat.

For example, in response to the beat being detected, the processor 140 may detect the intensity of the user touch based on the acceleration value, and convert the detected intensity of the user touch to a sound volume level again.

Different sounds may be set according to the plurality of pads 110. For example, a beat sound of a low- and middle-pitched tone may be set to the first pad among the plurality of pads 110, and a beat sound of a high-pitched tone may be set to the second pad. In response to the beat on the first pad being detected, the processor 140 may detect the intensity of the user touch based on the acceleration value, convert the detected intensity of the user touch to a beat sound volume level of the low- and middle-pitched tone again, and output the low- and middle-pitched beat sound having the converted volume level through the sound output interface 120.

In response to the beat on the second pad being detected, the processor 140 may detect the intensity of the user touch based on the acceleration value, convert the detected intensity of the user touch to a beat sound volume level of the high-pitched sound again, and output the high-pitched beat sound having the converted volume level through the sound output interface 120.

In response to the beats on the first pad and the second pad being simultaneously detected, the processor 140 may detect an intensity of a first user touch and an intensity of a second user touch based on the acceleration values of the first pad and the second pad, and convert the detected intensity of the first user touch and the detected intensity of the second user touch to a beat sound volume level of the low- and middle-pitched sound and a beat sound volume level of the high-pitched sound again. In an example, the processor 140 may output the low- and middle-pitched beat sound having the converted volume level and the high-pitched beat sound having the converted volume level through the sound output interface 120. In another example, the processor 140 may mix the low- and middle-pitched beat sound having the converted volume level and the high-pitched beat sound having the converted volume level and output the mixed sound through the sound output interface 120.

In response to the beats on the first pad and the second pad being simultaneously detected, one or more exemplary embodiments may be presented.

For example, as described above, in response to the beats on the first pad and the second pad being simultaneously detected, the processor 140 may independently output the sounds set to the first pad and the second pad based on the intensity of the first user touch and the intensity of the second user touch, which are detected based on the acceleration values of the first pad and the second pad, through the sound output interface 120. In another example, the processor 140 may output a mixed sound through the sound output interface 120 by mixing the sounds set to the first pad and the second pad. The phrase "independently output the sounds set to the first pad and the second pad" may refer to "separately output the sound set to the first pad and the sound set to the second pad through different channels according to the plurality of speakers" in the processor 140. The phrase "output a mixed sound by mixing the sound set to the first pad and the second pad" may refer to "mix the sounds set to the first pad and the sound set to the second pad and transfer the mixed sound through one channel to speaker to be output" in the processor 140.

In another example, in response to the beats on the first pad and the second pad being simultaneously detected, the processor 140 may determine a priority on the sounds set to the first pad and the second pad, and selectively output one of the sounds set to the first pad and the second pad according to the determined priority.

In this example, in response to the priority being set to the sound set to the first pad and the sound set to the first pad being output in preference to the sound set to the second pad, the processor 140 may output only the sound set to the first pad through the sound output interface 120 even in response to the beats on the first pad and the second pad being simultaneously detected.

In another example, in response to the beats on the first pad and the second pad being simultaneously detected in a state that the priority is not set to output any one of the sounds set to the first pad and the second pad, the processor 140 may compare the intensity of the first user touch detected based on the acceleration value of the first pad with the intensity of the second user touch detected based on the acceleration value of the second pad, and output the sound set to one of the first pad and second pad that has the relatively large touch intensity.

In this example, the processor 140 may compare the detected intensity of the first user touch for the first pad with the detected intensity of the second user touch for the second pad in response to the beats on the first pad and the second pad being simultaneously detected, and output only the sound set to the first pad through the sound output interface 120 in response to being determined that the intensity of the first user touch is larger than the intensity of the second user touch.

In another example, in response to the beats on the first pad and the second pad being simultaneously detected, the processor 140 may mix the sounds set to the first pad and the second pad by adjusting a ratio between the sound set to the first pad and the sound set to the second pad based on the intensity of the first user touch and the intensity of the second user touch, and output the mixed sound.

In the operation of determining whether or not the beats on the first pad and the second pad are simultaneously detected, the processor 140 may naturally determine that the beats on the first pad and the second pad are simultaneously detected in response to the beats on the first pad and the second being theoretically detected at the same time. However, the processor 140 may determine that the beats on the first pad and the second pad are simultaneously detected in response to the beats on the first pad and the second being sequentially detected within a preset time.

That is, it is actually difficult to simultaneously detect the beats on the first pad and the second pad at the same time. Accordingly, the processor 140 may determine that the beats on the first pad and the second pad are simultaneously detected even in response to the beats on the first pad and the second being sequentially detected within the preset time.

The processor 140 may provide the visual feedback corresponding to the beat. For example, the processor 140 may provide the visual feedback corresponding to the beat by differently determining the visual feedback based on the intensity of the beat.

That is, the processor 140 may provide the visual feedback indicating that the beat is performed. For example, the display 130 may include an LED unit, and the processor 140 may turn on an LED corresponding to the beat-detected pad in the LED unit, and adjust at least one of brightness and color of the LED according to the intensity of the beat.

Figure 14A:
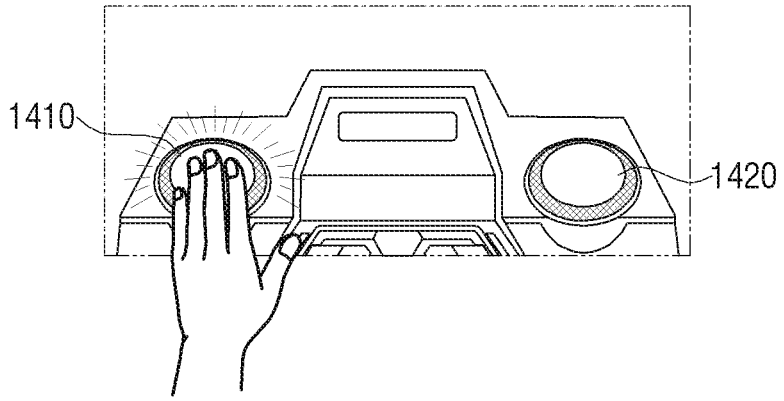
FIGS. 14A and 14B are diagrams illustrating visual feedback corresponding to a beat according to an exemplary embodiment.
Figure 14B:
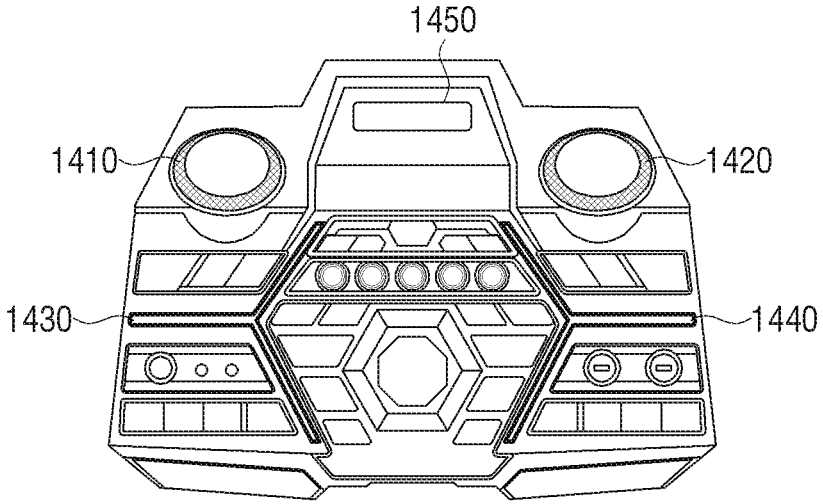

FIGS. 14A and 14B are diagram illustrating visual feedback corresponding to a beat according to an exemplary embodiment.

Referring to FIG. 14A, in response to a left pad being beaten by the user in a state that two pads are provided in the electronic apparatus 100, the processor 140 controls an LED 1410 around the left pad to be light-emitted.

Similarly, in response to a right pad being beaten by the user, the processor 140 may control an LED 1420 around the right pad to be light-emitted.

That is, to indicate whether or not the beat on a pad is performed and whether which pad is beaten, the processor 140 may turn on an LED corresponding to the beaten pad.

The processor 140 may adjust at least one among brightness, color, and a light-emitting pattern of the LED 1410 around the left pad according to the intensity of the beat. For example, the processor 140 may adjust the brightness of the LED 1410 around the left pad according to the intensity of the beat. In this example, the processor 140 may increase the brightness of the LED 1410 around the left pad as the intensity of the beat is increased, and reduce the brightness of the LED 1410 around the left pad as the intensity of the beat is reduced.

In another example, the processor 140 may change the color of the LED 1410 around the left pad according to the intensity of the beat. In this example, the processor 140 may change the color of the LED 1410 to red (R) as the intensity of the beat is increased, and may change the color of the LED 1410 to green (G) as the intensity of the beat is reduced.

In another example, the processor 140 may adjust the light-emitting pattern of the LED 1410 around the left pad according to the intensity of the beat. In this example, the processor 140 may control a relatively large amount of light to be emitted for the same time by adjusting a period of the light-emitting pattern of the LED 1410 to be short as the intensity of the beat is increased. The processor 140 may control a relatively small amount of light to be emitted for the same time by adjusting the period of the light-emitting pattern of the LED 1410 to be long as the intensity of the beat is reduced.

The above-described examples may be equally applied to the right pad.

Referring to FIG. 14B, the display 130 includes a window 1450 configured to display a screen and LEDs 1430 and 1440 provided in one region of the electronic apparatus 100 in addition to the LEDs 1410 and 1420 around the plurality of pads.

For example, in response to a left pad being beaten by the user, the processor 140 may adjust at least one of brightness, colors, and light-emitting patterns of the LED 1410 around the left pad and the LED 1430 corresponding to a direction in which the left pad is located.

In another example, in response to a right pad being beaten by the user, the processor 140 may adjust at least one of brightness, colors, and light-emitting patterns of the LED 1420 around the right pad and the LED 1440 corresponding to a direction in which the right pad is located.

The window 1450 configured to display a screen may perform a visualizer function by displaying an image having a preset pattern according to the beat on the light pad or the right pad and the intensity of the beat.

As long as the beat is detected regardless of whether a beat on a first pad is performed or a beat for a second pad is performed, the processor 140 may turn on all the LEDs 1410 and 1420 around the plurality of pads, the window 1450 configured to display a screen, and the LEDs 1430 and 1440 provided in the one region of the electronic apparatus 100.

As described above, for example, in response to the first pad and the second pad being simultaneously detected, the processor 140 may separately control the LEDs 1410 and 1420 around the plurality of pads, the window 1450 configured to display a screen, and the LEDs 1430 and 1440 provided in the one region of the electronic apparatus 100 to be individually turned on. In another example, the processor 140 may simultaneously control the LEDs 1410 and 1420 around the plurality of pads, the window 1450 configured to display a screen, and the LEDs 1430 and 1440 provided in the one region of the electronic apparatus 100 to be collectively turned on.

FIG. 14B illustrates that the electronic apparatus 100 includes two pads, but the electronic apparatus 100 may include two pads or more. A structure and a shape of the electronic apparatus 100, the number of pads, an arrangement structure of the LEDs, and the like are not limited to those illustrated in FIG. 14B, and may be variously implemented.

Figure 15:
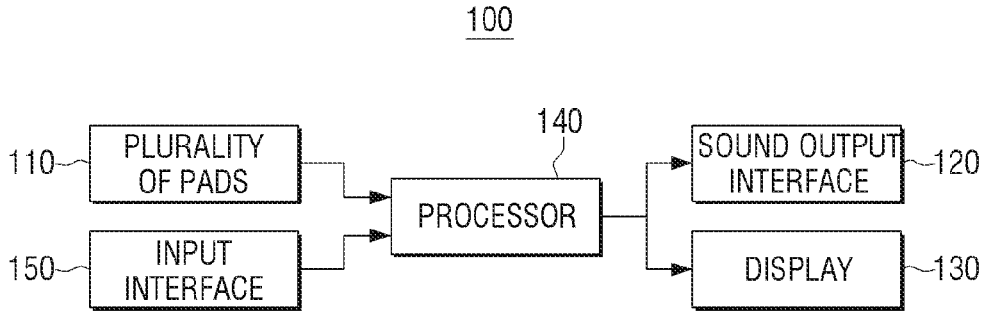
FIG. 15 is a block diagram illustrating a configuration of an electronic apparatus according to another exemplary embodiment.

FIG. 15 is a block diagram illustrating a configuration of an electronic apparatus according to another exemplary embodiment.

Referring to FIG. 15, the electronic apparatus 100 further includes an input interface 150 in addition to the plurality of pads 110, the sound output interface 120, the display 130, and the processor 140.

The input interface 150 may receive sound content from an external source. The processor 140 may output sound by mixing the received sound content and a sound of a type set to the beat-detected pad.

For example, the external source may include all apparatus capable of storing the sound content or reproducing the sound content, for example, an external storage medium such as a universal serial bus (USB), a compact disc (CD) player, an audio, a laptop PC, a PDA, a TV, and the like. In another example, the external source may include a server, a web site, and the like connectable through wireless communication or wired communication.

The processor 140 may reproduce the sound content received from the external source, and output the reproduced sound content through the sound output interface 120. The processor 140 may provide different visual feedback based on information for the received sound content.

For example, the information for the sound content may include meta data for a sound frequency, a tempo and the like of the sound content. While the processor 140 reproduces the sound content, the processor 140 may adjust at least one of brightness, colors, and light-emitting patterns of the LEDs 1410 and 1420 around the pads and the LEDs 1430 and 1440 provided in the one region of the electronic apparatus 100 illustrated in FIG. 14B based on the meta data for the sound frequency, the tempo, and the like of the sound content.

For example, in response to the sound frequency of the sound content having a high frequency band and the beat having a fast tempo, the processor 140 may change the colors of the LEDs 1410 and 1420 around pads and LEDs 1430 and 1440 provided in the one region of the electronic apparatus illustrated in FIG. 14B to red (R), increase the brightness of the LEDs 1410 and 1420 and LEDs 1430 and 1440, and adjust the periods of the light-emitting patterns of the LEDs 1410 and 1420 and LEDs 1430 and 1440 to be short.

In another example, in response to the sound frequency of the sound content having a low frequency band and the beat having a slow tempo, the processor 140 may change the colors of the LEDs 1410 and 1420 around pads and LEDs 1430 and 1440 provided in the one region of the electronic apparatus illustrated in FIG. 14B to green (G), reduce the brightness of the LEDs 1410 and 1420 and LEDs 1430 and 1440, and adjust the periods of the light-emitting patterns of the LEDs 1410 and 1420 and LEDs 1430 and 1440 to be long.

That is, while the processor 140 reproduces the input sound content based on the meta data for the sound content regardless of whether or not the beat on the plurality of pads 110 is performed, the processor 140 may adjust at least one of color, brightness, and a light-emitting pattern of the LED based on the sound frequency, the tempo, and the like of the sound content.

In another example, the processor 140 may display sound content-related information based on the meta data for the input sound content through the window 1450 configured to display a screen. The sound content-related information may include a variety of information such as sound content track information, a number of a music file currently being reproduced, information for previous music file and next music file, a music file name, and a composer.

The processor 140 may output a mixed sound by mixing the input sound content and the sound of a type set to the beat-detected pad. In response to the mixed sound being output, the processor 140 may provide different visual feedbacks based on the information for the input sound content and the beat intensity.

For example, in response to at least one of the plurality of pads 110 being beaten by the user while the sound content is reproduced and simultaneously at least one of the colors, the brightness, and light-emitting patterns of the LEDs 1410 and 1420 around the pads and LEDs 1430 and 1440 provided in the one region of the electronic apparatus 100 illustrated in FIG. 14B is changed according to the sound content, the processor 140 may adjust the at least one of the colors, the brightness, and light-emitting patterns of the LEDs 1410 and 1420 around the pads and LEDs 1430 and 1440 provided in the one region of the electronic apparatus 100 illustrated in FIG. 14B in consideration of both the metal data for the input sound content and the beat intensity.

That is, in response to at least one of the plurality of pads 110 being beaten by the user in a state that the colors of the LEDs 1410 and 1420 around the pads and LEDs 1430 and 1440 provided in the one region of the electronic apparatus 100 illustrated in FIG. 14B are green (G) and the brightness thereof is reduced with respect to the reproduced sound content, the processor 140 may change the colors of the LEDs 1410 and 1420 around the pads and LEDs 1430 and 1440 provided in the one region of the electronic apparatus 100 illustrated in FIG. 14B to red (R) and increase the brightness of the LEDs 1410 to 1440 based on the beat intensity.

In another example, in response to at least one of the plurality of pads 110 being continuously beaten fast in a state that the periods of the light-emitting patterns of the LEDs 1410 and 1420 around the pads and LEDs 1430 and 1440 provided in the one region of the electronic apparatus 100 illustrated in FIG. 14B are short with respect to the reproduced sound content, the processor 140 may change the periods of the light-emitting patterns of the LEDs 1410 and 1420 around the pads and LEDs 1430 and 1440 provided in the one region of the electronic apparatus 100 illustrated in FIG. 14B to be short.

As described above, in response to the sound content being reproduced and simultaneously the at least one of the plurality of pads 110 being beaten by the user, the processor 140 may provide different feedbacks based on the information for the sound content and the beat intensity.

The processor 140 may be operated as one of a first mode that outputs a mixed sound by mixing the input sound content and the sound of the type set to the beat-detected pad and a second mode that outputs only the input sound content other than the sound of the type set to the beat-detected pad.

For example, in response to the electronic apparatus 100 being used only for the purpose of reproducing the sound content by the user, the processor 140 may output only the input sound content in response to a function key for operating the second mode being pressed by the user, and the processor 140 may not output the sound corresponding to the user beat even in response to the user beat on the plurality of pads 110 being detected.

In response to the electronic apparatus 100 being used for the purpose of reproducing the sound content and simultaneously outputting a mixed sound by mixing the sound content and the sound of the type set to the beat-detected pad by the user, the processor 140 may output the mixed sound by mixing the sound content and the sound of the type set to the beat-detected pad based on the information for the sound content, the beat/non-beat, and the beat intensity in response to a function key for operating the first mode being pressed by the user.

Figure 16:
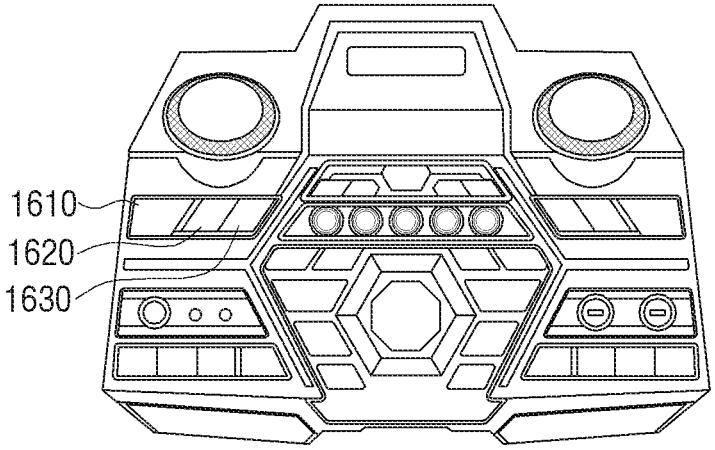
FIG. 16 is a diagram illustrating a function key for selecting a mode according to an exemplary embodiment.

FIG. 16 illustrates a function key for selecting a mode according to an exemplary embodiment.

Referring to FIG. 16, the function key includes a first key 1610, a second key 1620, and a third key 1630. For example, a function configured to determine whether to be operated as the first mode or the second mode may be mapped to the first key 1610. In response to the first key 1610 being pressed by the user, the processor 140 may be operated as the first mode, and in response to the first key 1610 being pressed by the user again, the processor 140 may be operated as the second mode.

Functions configured to change a plurality of sounds set according to the plurality of pads 110 may be mapped to the second key 1620 and the third key 1630. Accordingly, in response to one of the second key 1620 and the third key 1630 being selected by the user, the processor 140 may selectively change the plurality of sounds set according to the plurality of pads 110.

For example, in response to the second key 1620 being consecutively pressed, the sound may be changed in order of a drum sound, a tom-tom sound, and a cymbals sound, and in response to the third key 1630 being consecutively pressed, the sound may be inversely changed in order of the cymbals sound, tom-tom sound, and the drum sound.

Figure 17:
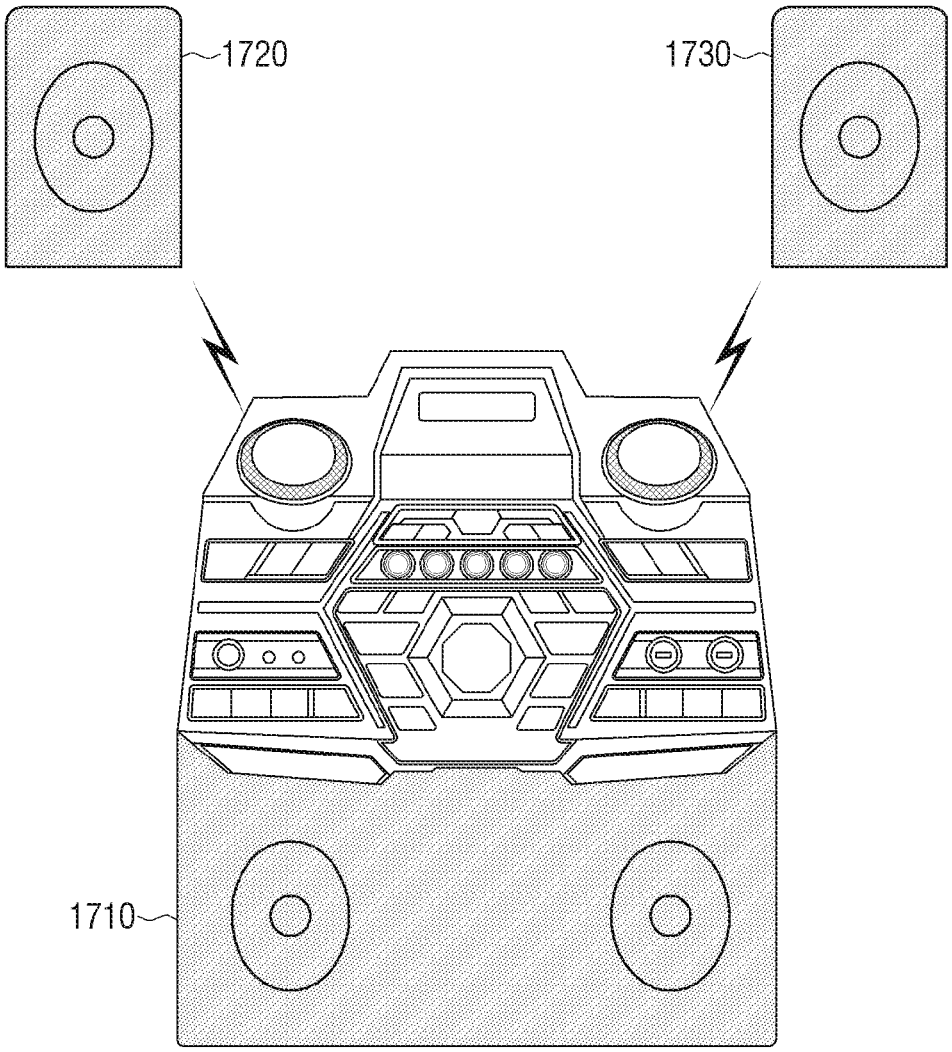
FIGS. 17 and 18 are diagrams illustrating usage examples of an electronic apparatus according to an exemplary embodiment.
Figure 18:
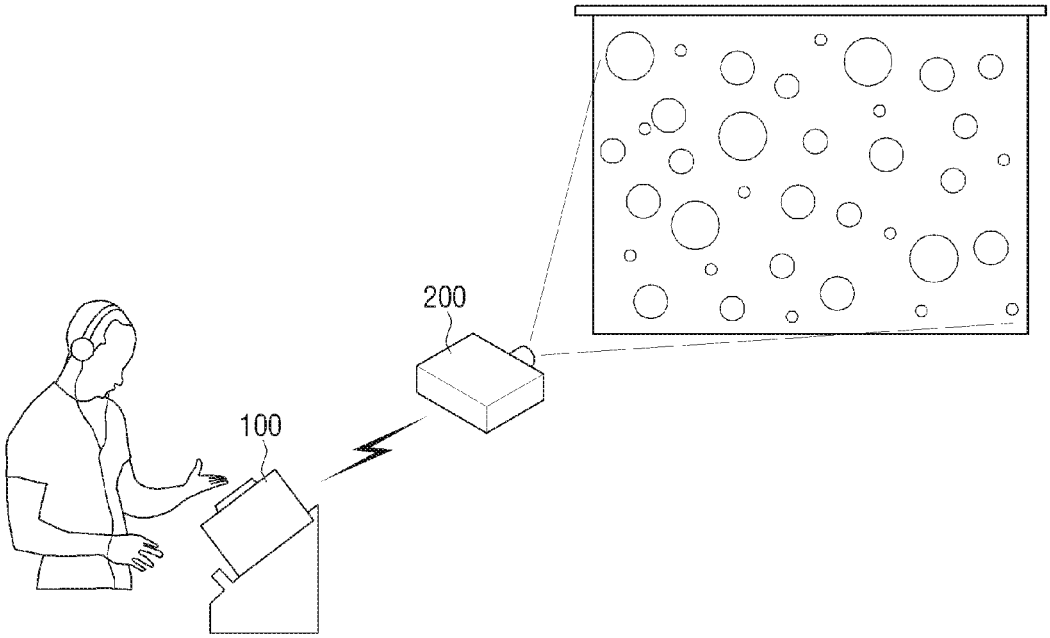

FIGS. 17 and 18 are diagrams illustrating usage examples of an electronic apparatus according to an exemplary embodiment.

Referring to FIG. 17, a first speaker 1710 is disposed in a lower end of the electronic apparatus 100. The electronic apparatus 100 may output sound through wireless or wired communication with the first speaker 1710.

Accordingly, the user may operate the electronic apparatus 100 in a standing state by disposing the electronic apparatus 100 on the first speaker 170.

The electronic apparatus 100 may output sound by performing communication with a plurality of network speakers 1720 and 1730.

For example, the electronic apparatus 100 may include a communication unit, and the communication unit may couple a communication session by performing pairing with the plurality of network speakers 1720 and 1730. The communication unit may transfer the sound content or the sound of the type set to the beat-detected pad to the plurality of network speakers 1720 and 1730 to be output.

Accordingly, the processor 140 may output the sound content or the sound of the type set to the beat-detected pad as a surround-sound through the first speaker 1710 disposed in the lower end of the electronic apparatus 100 and the plurality of network speakers 1720 and 1730.

The electronic apparatus 100 may perform various functions by performing communication with other external apparatuses.

Referring to FIG. 18, the electronic apparatus 100 controls a projector apparatus 200 to project an image corresponding to the sound content or the sound of the type set to the beat-detected pad by performing communication with the projector apparatus 200.

For example, the processor 140 may not only provide the feedback through the LED unit provided in the electronic apparatus 100 or the window configured to display a screen but also provide visual feedback through the function of the projector apparatus 200 by performing communication with the projector apparatus 200.

For example, the processor 140 may control the projector apparatus 200 to perform a visualizer function that the image is changed according to the information for the sound content and the beat intensity. The visualizer technology is for visualizing the image by changing a size of a particle, a distance between particles, a geometric pattern, and a preset image according to the sound frequency. The visualizer technology is known, and thus detailed description thereof will be omitted.

FIG. 18 illustrates the example that the external apparatus is the projector apparatus, but the external apparatus is not limited to the projector apparatus, and the external apparatus may include various electronic apparatuses.

For example, the external apparatus may be implemented with a display apparatus such as a TV, and the processor 140 may output the sound content and the sound of the type set to the beat-detected pad through the sound output interface 120, and simultaneously transmit a control signal for generating or changing an image according to the information for the sound content and the beat intensity to the TV. Accordingly, the TV may perform the visualizer function that displays the image according to the sound content and the sound of the type set to the beat-detected pad output from the electronic apparatus 100 based on the received control signal.

A remote controller apparatus configured to control the electronic apparatus 100 may be provided. For example, the remote control apparatus may be attached to and stored in an outside of the electronic apparatus 100. In another example, the user may carry out the remote control apparatus, and control the electronic apparatus 100 by operating the remote control apparatus.

In this example, the remote control apparatus may include a plurality of function keys to which a function for turning on/off the electronic apparatus 100, a mute function, a function for coupling and controlling an external input (TV, USB, CD, tuner, AUX, and the like), a function related to sound content reproduction (PLAY, PAUSE, REPEAT, STOP, and the like), a volume control function, a file seek function, a timer on/off function, a display function, a user custom function, a function for determining whether or not to output the mixed sound by mixing the sound content and the sound of the type set to the beat-detected pad (the function for selecting one of the first mode and the second mode described above), and the like are mapped. In response to a touch screen being included in the remote control apparatus, the above-described functions may be matched with objects such as a menu or an icon displayed on a user interface screen.

The pad touched by the user may be configured of one channel, and in response to any region of the pad being touched by the user, the processor 140 may output sound set to the pad according to the intensity of the user touch regardless of a position of the region constituting the pad.

The pad may be divided into a plurality of regions, and include multi-channels capable of detecting the user touch and the intensity of the user touch according to the regions.

Figure 19:
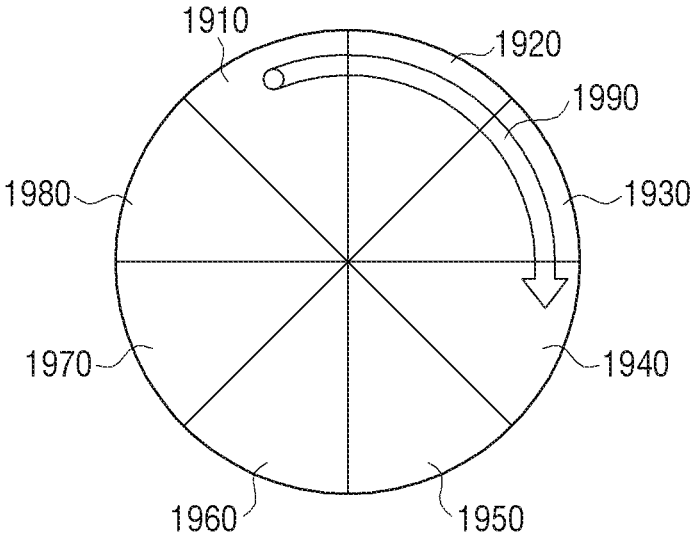
FIG. 19 is a diagram illustrating a multichannel structure of a pad according to an exemplary embodiment.

FIG. 19 is a diagram illustrating a multichannel structure of a pad according to an exemplary embodiment.

Referring to FIG. 19, a pad is divided into a total of eight regions 1910, 1920, 1930, 1940, 1950, 1960, 1970, and 1980. The processor 140 may individually detect user touches and intensities of the user touches with respect to the divided eight regions 1910 to 1980. Even in response to the pad being divided into a plurality of regions, the processor 140 may calculate an offset for the gravitational acceleration for each region, reflect the calculated offset to an acceleration sensor signal acquired according to the regions, and output the sound by determining a sound volume level according to the regions based on the acceleration value calculated by calculating an absolute value for the offset-reflected acceleration sensor signal as described above.

For example, in response to the pad being divided into the plurality of regions, the user may perform a dragging operation (hereinafter, referred to as a scratching operation) in a state that the user maintains the user touch on a partial region of the plurality of regions, and the processor 140 may perform a function corresponding to the scratching operation by regarding even one user touch as the plurality of user touches input through other regions.

For example, referring to FIG. 19, in response to a scratching operation 1990 that touches the first region 1910 and then drags up to the fourth region 1940 via the second region 1920 and the third region 1930 in the touched state on the first region 1910 being performed by the user, the processor 140 may determine the scratching operation 1990 by dividing a first user touch detected in the first region 1910, a second user touch detected in the second region 1920, a third user touch detected in the third region 1930, and a fourth touch detected in the fourth region 1940, and determine that the scratching operation 1990 is input in response to the user touch being continuously detected on the plurality of regions.

The processor 140 may output the sound corresponding to the scratching operation in response to being determined that the scratching operation is input. For example, the processor 140 may output the sound of a high-pitched staccato tempo for a time corresponding to the scratching operation.

As illustrated in FIG. 19, the user may not perform the scratching operation only to one direction but may change the direction of the scratching operation plural times.

For example, the user may perform the scratching operation that starts to touch from the first region 1910, and drags up to the second region 1920 and drags to the first region 1910 again by changing the drag direction in the touched state. In this example, the processor 140 may determine the scratching operation by separately dividing a first user touch detected in the first region 1910, a second user touch detected in the second region 1920, and the first user touch detected in the first region 1910.

The processor 140 may output the sound by differently changing a sound corresponding to the scratching operation that drags from the first region 1910 to the second region 120 and a sound corresponding to the scratching operation that drags from the second region 1920 to the first region 1910.

Accordingly, the user may perform an operation indicating more various musical effects on the pad divided into the plurality of regions.

Figure 20:
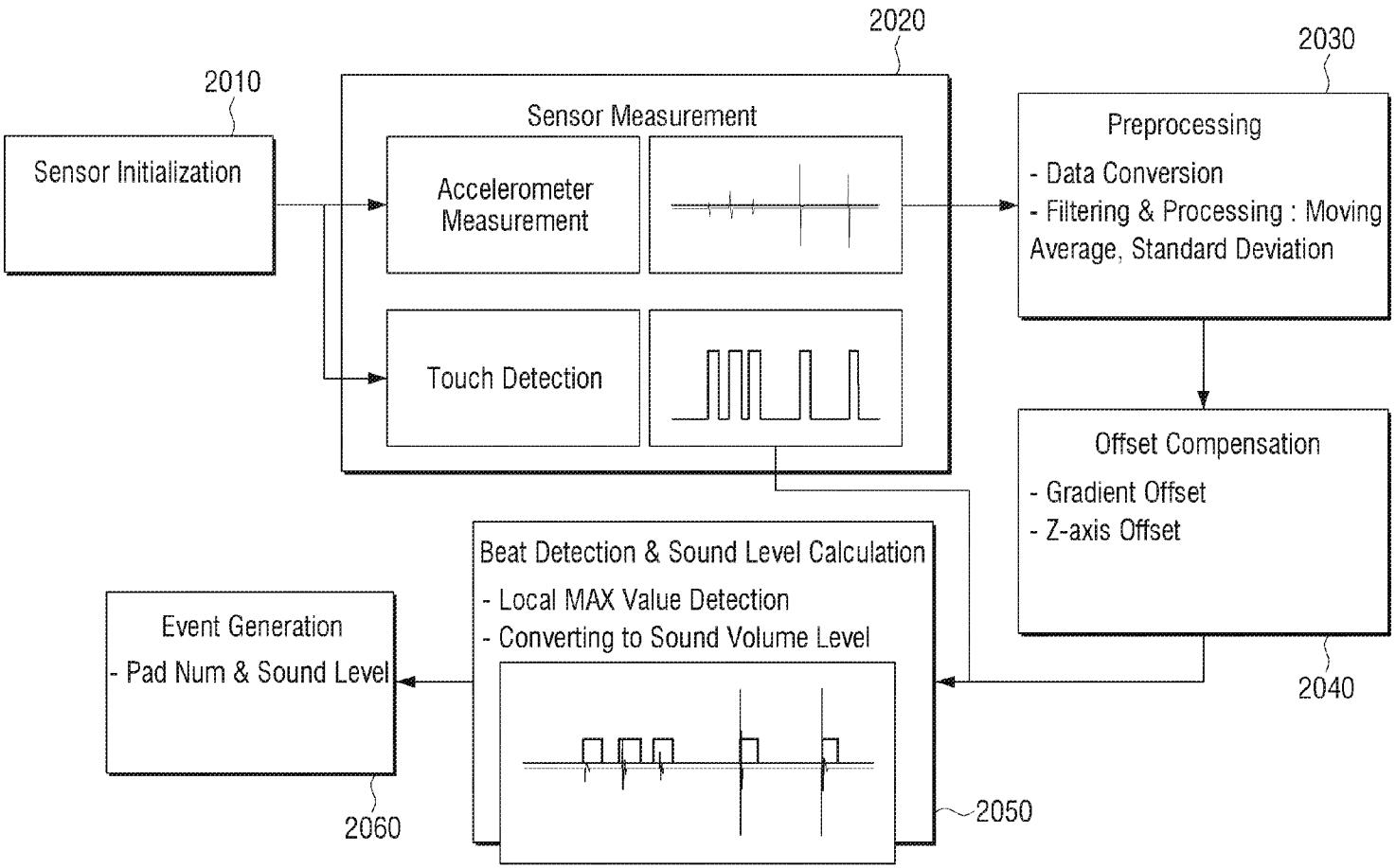
FIG. 20 is a block diagram illustrating a configuration of a beat detection algorithm according to an exemplary embodiment.

FIG. 20 is a block diagram illustrating a beat detection algorithm according to an exemplary embodiment.

Referring to FIG. 20, the processor 140 performs a sensor initialization operation 2010, a sensor measurement operation 2020, a preprocessing operation 2030, an offset compensation operation 2040, a maximum value beat detection and sound level calculation operation 2050, and an event generation operation 2060.

For example, while the processor 140 performs the sensor initialization operation 2010, the processor 140 may initialize previously input signals to the acceleration sensor and the touch sensor by setting the previously input signals to 0 (zero).

While the processor 140 performs the sensor measurement operation 2020, the processor 140 may acquire the acceleration sensor signal (perform accelerometer measurement) and the touch sensor signal (perform touch detection). For example, the processor 140 may acquire the touch sensor signal corresponding to the user touch for the first pad of the plurality of pads 110 and the acceleration sensor signal corresponding to the intensity of the user touch.

Similarly, the processor 140 may acquire the touch sensor signal corresponding to the user touch for the second pad of the plurality of pads 110 and the acceleration sensor signal corresponding to the intensity of the user touch. The processor 140 may acquire the acceleration sensor signals and the touch sensor signals input to the plurality of pads 110.

The input acceleration sensor signal and the touch sensor signal may be values from which the offset for the gravitational acceleration is not removed.

The processor 140 may perform the preprocessing operation 2030. For example, the processor 140 may convert the acceleration sensor signal and the touch sensor signal that are digital signals to analog signals, and perform a filtering and processing operation for calculating the offset for the gravitational acceleration by calculating the section average and the section standard deviation of the acceleration sensor signal.

The offset may be an offset according to a slope or a gradient of the electronic apparatus 100 or an offset to be applied to the Z-axis data of the acceleration sensor signal.

The processor 140 may perform the offset compensation 2040 by reflecting the calculated offset to the acceleration sensor signal.

In the maximum value beat detection and sound level calculation operation 2050, the processor 140 may calculate an absolute value for the offset-compensated acceleration sensor signal, and detect the maximum value within a preset section from the absolute value of the offset-compensated acceleration sensor signal.

The processor 140 may determine whether or not the beat by the user is performed according to whether or not the acceleration value is more than or equal to a preset threshold value based on the absolute value of the offset-compensated acceleration sensor signal and whether or not the touch value of the touch sensor signal is changed from OFF to ON.

In response to being determined that the beat on the corresponding pad is performed, the processor 140 may perform an operation for converting the detected maximum value to a sound volume level corresponding thereto.

For example, in response to being assumed that the maximum value of the acceleration sensor signal is in a range of from 0 (zero) to 1024, the sound level may be matched according to the maximum value having the value of from 0 (zero) to 1024. Accordingly, the processor 140 may output the sound having the sound level converted based on the maximum value of the acceleration sensor signal.

The event generation operation 2060 performed in the processor 140 may be an operation of outputting the sound level set according to the pad with the converted sound level. The processor 140 may output the sound level matched with the beat-detected pad (i.e., a pad number), and thus provide the auditory feedback with respect to whether the user beats which pad among the plurality of pads with which intensity level.

Figure 21:
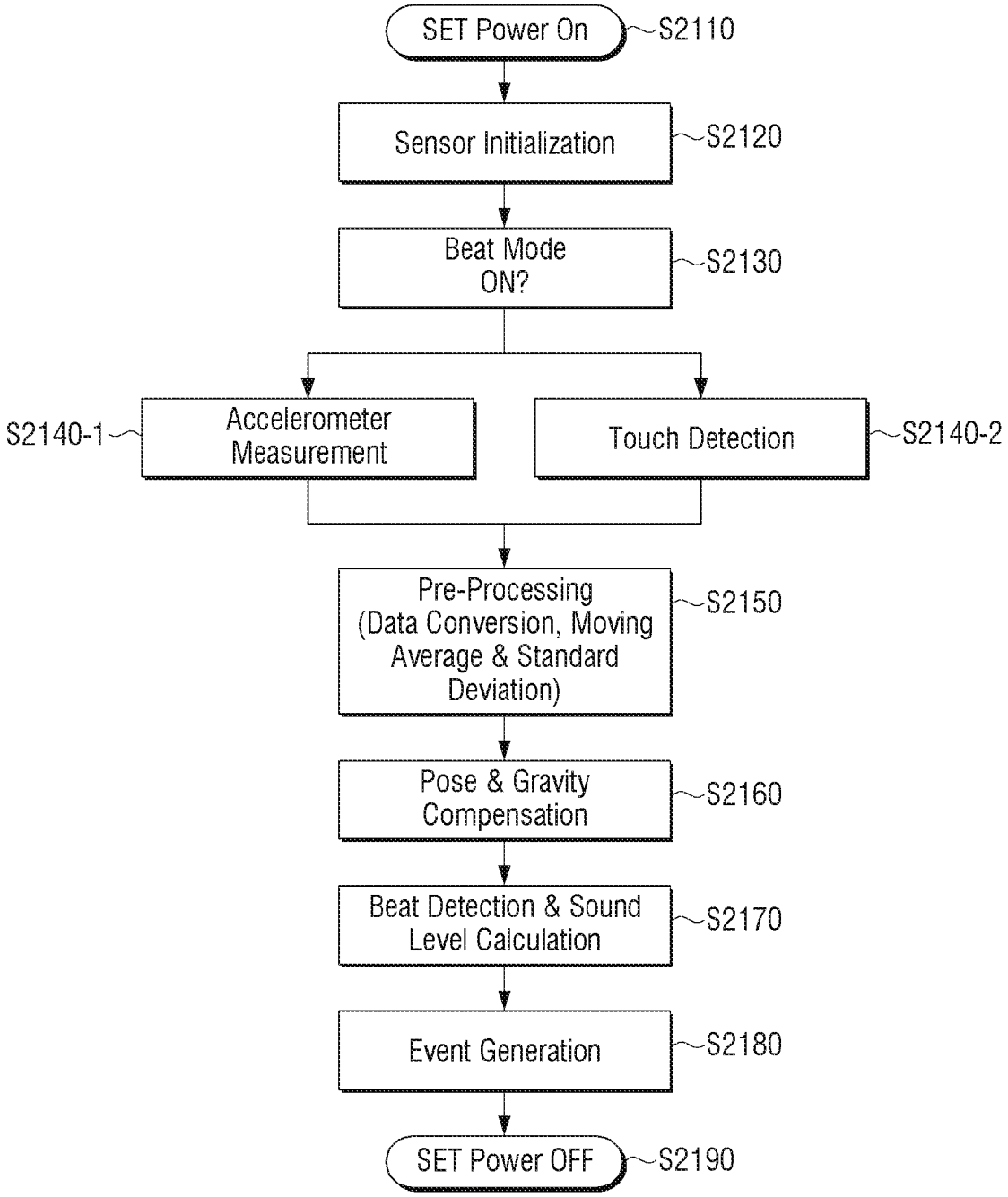
FIGS. 21 and 22 are flowcharts illustrating operation processes according to one or more exemplary embodiments.
Figure 22:
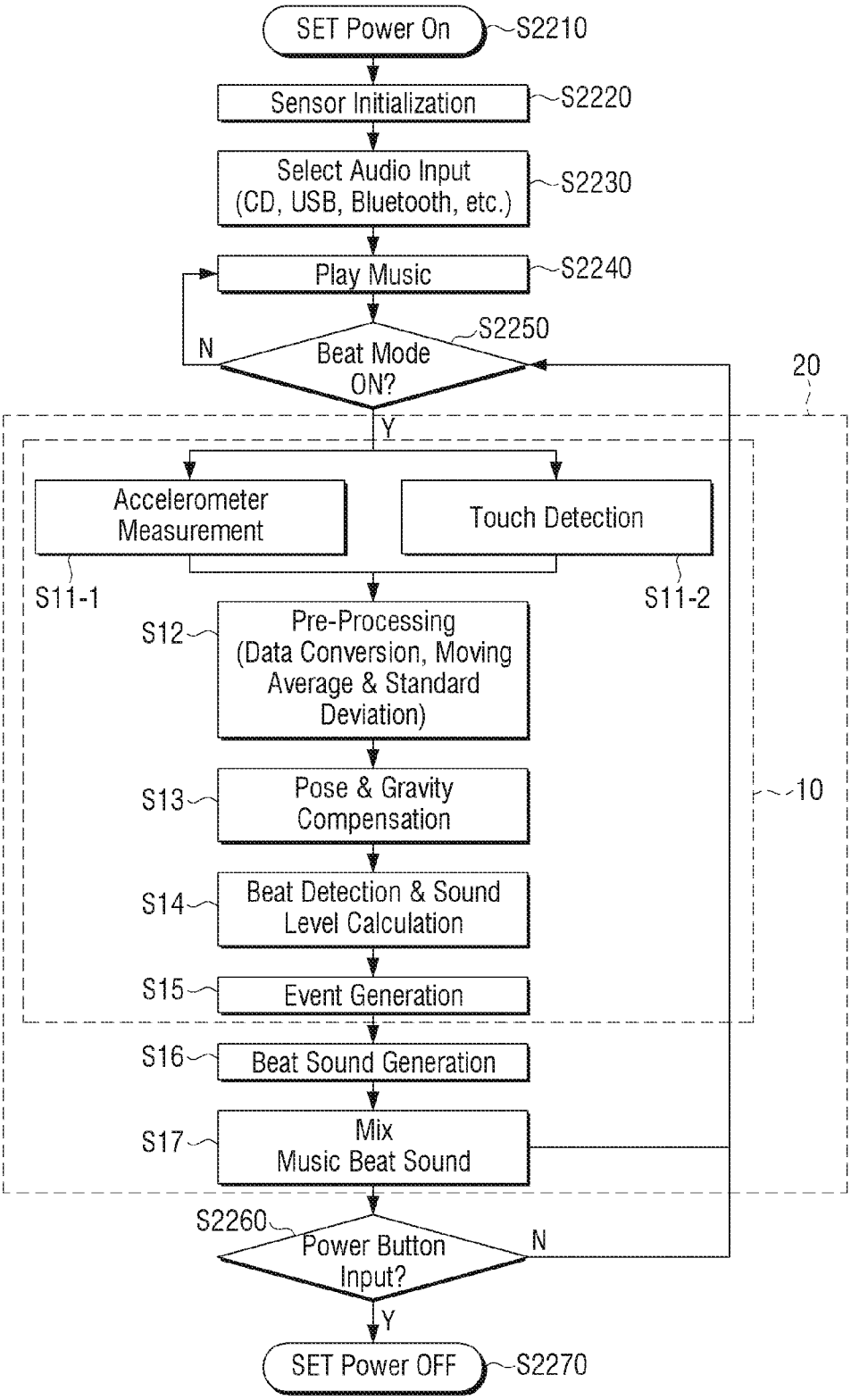

FIGS. 21 to 22 are flowcharts illustrating operation processes according to one or more exemplary embodiments.

Referring to FIG. 21, a power of the electronic apparatus 100 is set to ON (S2110), and the processor 140 initializes the acceleration sensor and the touch sensor (S2120). The processor 140 may initialize various sensors other than the acceleration sensor and the touch sensor. For example, the processor 140 may initialize a gyro sensor, an illumination sensor, a motion detection sensor, and the like.

The processor 140 determines whether or not a beat mode is an ON state (S2130). The beat mode may refer to a mode that may output a sound of a type set to the user beat-detected pad, or output the sound content with the sound.

In response to the beat mode being the ON state, the processor 140 acquires an acceleration sensor signal (an accelerometer measurement) through the acceleration sensor provided in each of the plurality of pads (S2140-1), and acquires a touch sensor signal (a touch detection) through the touch sensor provided in each of the plurality of pads (S2140-2).

The processor 140 performs pre-processing (S2150). In detail, the processor 140 converts the acceleration sensor signal and the touch sensor signal that are digital signals to an acceleration sensor signal and a touch sensor signal that are analog signals, and calculates a section average and a section standard deviation.

The processor 140 performs pose and gravity compensation (S2160). In detail, the processor 140 may calculate an offset in consideration of an arrangement state or a slope of the electronic apparatus 100 based on the calculated section average and section standard deviation, and may reflect the calculated offset to the acceleration sensor signal.

The processor 140 may calculate an absolute value of the offset-compensated acceleration sensor signal, and detect a maximum value within a preset section from the absolute value of the offset-compensated acceleration sensor signal.

The processor 140 performs beat detection and sound level calculation (S2170). In detail, the processor 140 may determine whether or not the user beat is performed according to whether or not the acceleration value is more than or equal to a preset threshold value based on the absolute value of the offset-compensated acceleration sensor signal and whether or not the touch value of the touch sensor signal is changed from OFF to ON. In response to being determined that the beat on the corresponding pad is performed, the processor 140 may perform an operation for converting the detected maximum value to a sound level corresponding thereto.

The processor 140 performs an event generation operation that outputs the sound set to a corresponding pad on which a beat is performed (S2180). In response to the beat being performed on the plurality of pads, the processor 140 may separately output sounds set to the plurality of pads or may output a mixed sound by mixing the sounds set to the plurality of pads.

In response to the power of the electronic apparatus being set to OFF according to a user operation (S2190), all operations are terminated.

Referring to FIG. 22, a power of the electronic apparatus 100 is set to ON (S2210), and the processor 140 initializes the acceleration sensor and the touch sensor (S2220). The processor 140 may initialize various sensors other than the acceleration sensor and the touch sensor as described above.

In response to an external audio input source being selected according to a user operation (S2230), the processor 140 may perform wireless communication or wired communication with the selected external input source, and download sound content by performing streaming or read-out on the sound content.

The external input source may be an external apparatus and the like connectable through a CD, a USB, and Bluetooth.

The processor 140 plays music, or reproduces the sound content downloaded through the streaming or read-out (S2240). The processor 140 may provide different visual feedback based on the reproduced sound content. The providing of the different visual feedback has been described above, and thus detailed description thereof will be omitted.

The processor 140 may reproduce the sound content, and simultaneously determine whether or not a beat mode is an ON state (S2250). The beat mode may refer to the first mode out of the first mode that mixes the input sound content with the sound of the type set to the beat-detected pad and outputs a mixed sound, and the second mode that outputs only the input sound content other than the sound of the type set to the beat-detected pad.

In response to the beat mode being the ON state, while the processor 140 may reproduce the sound content, the processor 140 acquires an acceleration sensor signal (an accelerometer measurement) through the acceleration sensor provided in each of the plurality of pads (S11-1), and acquires a touch sensor signal (touch detection) through the touch sensor provided in each of the plurality of pads (S11-2).

The processor 140 performs pre-processing (S12). In detail, the processor 140 converts the acceleration sensor signal and the touch sensor signal that are digital signals to an acceleration sensor signal and a touch sensor signal that are analog signals, and calculates a section average and a section standard deviation.

The processor 140 performs post and gravity compensation (S13). In detail, the processor 140 may calculate an offset in consideration of an arrangement state or a slope of the electronic apparatus 100 based on the calculated section average and section standard deviation, and may reflect the calculated offset to the acceleration sensor signal.

The processor 140 may calculate an absolute value of the offset-compensated acceleration sensor signal, and detect a maximum value within a preset section from the absolute value of the offset-compensated acceleration sensor signal.

The processor 140 performs beat detection and sound level calculation (S14). In detail, the processor 140 may determine whether or not the user beat on a corresponding pad is performed according to whether or not an acceleration value is more than or equal to a preset threshold value based on the absolute value of the offset-compensated acceleration sensor signal and whether or not a touch value of the touch sensor signal is changed from OFF to ON. In response to being determined that the beat on the corresponding pad is performed, the processor 140 may perform an operation for converting the detected maximum value to a sound level corresponding thereto.

The processor 140 performs an event generation operation that generates the sound set to the corresponding pad on which the beat is performed (S15), and thus the processor 140 generates the beat sound (S16).

The processor 140 outputs a mixed sound by mixing the sound contents download through streaming or read-out from an external input source and the generated music beat sound (S17).

The processor 140 determines whether or not a turn-off command is input through a power button of the electronic apparatus 100 (S2260). In response to the turn-off command being input, the processor 140 turns off the electronic apparatus 100 (S2270). Accordingly, all operations of the electronic apparatus 100 are terminated.

In FIG. 22, a first processing section 10 including the plurality of operations S11-1, S11-2, S12, S13, S14, and S15 performed in the processor is a section for determining whether or not a beat on the corresponding pad is performed, and a second processing section 20 including the plurality of operations S11-1, S11-2, S12, S13, S14, S15, S16, and S17 performed in the processor is a section for determining whether the beat on the corresponding pad is performed, and generating the sound set to the pad in which the beat is performed and mixing the sound content and the generated sound.

Figure 23:
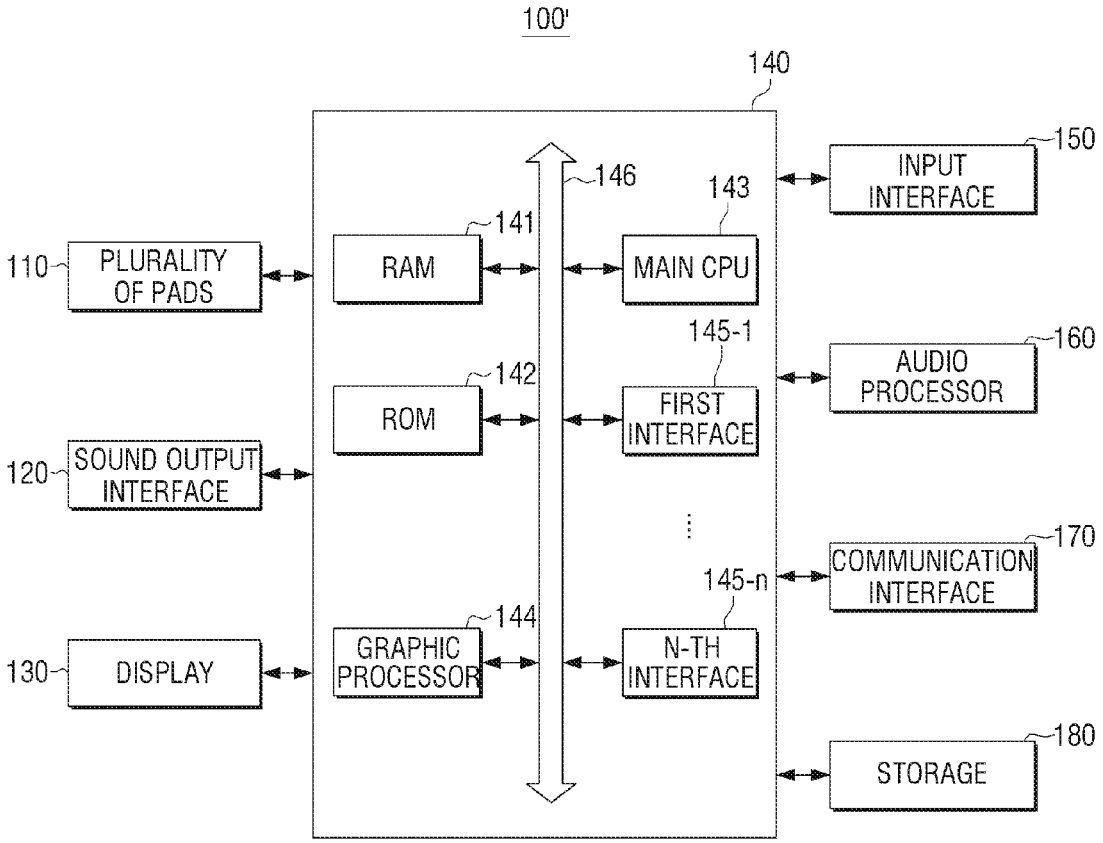
FIG. 23 is a block diagram illustrating a detailed configuration of the electronic apparatus illustrated in FIG. 1.

FIG. 23 is a block diagram illustrating a detailed configuration of the electronic apparatus illustrated in FIG. 1.

Referring to FIG. 23, an electronic apparatus 100' includes the plurality of pads 110, the sound output interface 120, the display 130, the processor 140, the input interface 150, an audio processor 160, a communication interface 170, and a storage 180. Detailed description for a portion of the configuration illustrated in FIG. 23 that overlaps the configuration illustrated in FIG. 1 will be omitted.

The processor 140 may control an overall operation of the electronic apparatus 100'.

For example, the processor 140 includes a random access memory (RAM) 141, a read only memory (ROM) 142, a main central processing unit (CPU) 143, a graphic processor 144, first to n-th interfaces 145-1 to **145-*n*, and a bus 146**.

The RAM 141, the ROM 142, the main CPU 143, the graphic processor 144, the first to n-th interfaces 145-1 to **145-*n*, and the like may be electrically coupled through the bus 146**.

The first to n-th interfaces 145-1 to **145-*n*** may be coupled to the above-described configuration components. One of the first to n-th interfaces may be a network interface coupled to an external apparatus through a network.

The main CPU 143 accesses the storage 180 to perform booting using an operating system (OS) stored in the storage 180. The main CPU 143 performs various operations using a variety of program, content, data, and the like stored in the storage 180.

A command set, and the like for system booting is stored in the ROM 142. In response to a turn-on command being input to supply power, the main CPU 143 may copy the OS stored in the storage 180 to the RAM 141 according to a command stored in the ROM 142, and execute the OS to boot a system. In response to the booting being completed, the main CPU 143 may copy various application programs stored in the storage 180 to the RAM 141, and execute the application programs copied to the RAM 141 to perform various operations.

The graphic processor 144 may be configured to generate a screen including various types of objects such as an icon, an image, and text using an operation unit and a rendering unit. The operation unit may calculate attribute values such as coordinate values, in which the various types of objects are displayed according to a layout of the screen, shapes, sizes, and colors based on a received control command. The rendering unit may generate the screen having various layouts including the objects based on the attribute values calculated in the operation unit. The screen generated in the rendering unit may be displayed through the display 130.

The operation of the processor 140 may be performed by program stored in the storage 180.

The storage 180 may store an OS software module for driving the electronic apparatus 100' and a variety of data such as various pieces of multimedia content.

For example, the storage 180 may include the various software modules that determine that a beat on at least one of the plurality of pads 110 is performed in response to a user touch in the at least one of the plurality of pads 110 being detected through a touch sensor and being detected that an intensity of the user touch is more than or equal to a preset threshold value through an acceleration sensor, control the sound output interface to output the sound of the type set to the beat-detected pad with a magnitude corresponding to the intensity of the beat, and provide visual feedback corresponding to the beat. The various software modules will be described in detail with reference to FIG. 24.

The communication interface 170 may perform communication with an external input source, an external apparatus, a remote control apparatus, and the like. The communication interface 170 may perform communication with the external input source, the external apparatus, the remote control apparatus, and the like through at least one of a wireless communication manner and a wired communication manner.

For example, the communication interface 170 may perform communication with a remote control apparatus according to a wireless communication manner or an infrared (IR) manner. The wireless communication method may include radio frequency identification (RFID), near field communication (NFC), Bluetooth, Zigbee, WiFi, and the like.

The audio processor 160 may process an audio signal to be suitable for user setup for an output range and sound quality of the sound output interface 120. For example, the audio processor 160 may process sound content input through the input interface 150 to be suitable for the user setup for the output range and sound quality of the sound output interface 120. In another example, the audio processor 160 may process the sound of the type set to the beat-detected pad to be suitable for the user setup for the output range and sound quality of the sound output interface 120.

Figure 24:
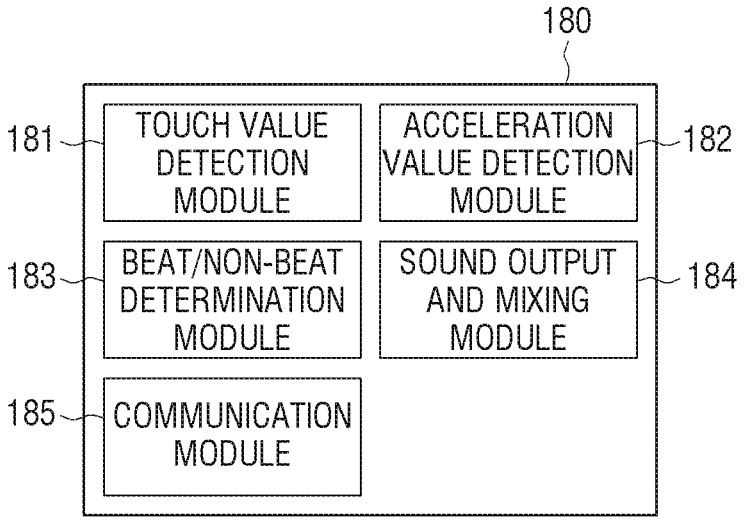
FIG. 24 is a diagram illustrating software modules that are stored in a storage according to an exemplary embodiment.

FIG. 24 is a diagram illustrating software modules that are stored in a storage according to an exemplary embodiment.

Referring to FIG. 24, programs such as a touch value detection module 181, an acceleration value detection module 182, a beat/non-beat determination module 183, a sound output and mixing module 184, a communication module 185, and the like may be stored in the storage 180.

The above-described operation of the processor 140 may be performed by the program stored in the storage 180. Hereinafter, a detailed operation of the processor 140 using the program stored in the storage 180 will be described in detail.

The touch value detection module 181 may perform a function to detect whether or not a touch value is changed from the touch sensor signal acquired through the touch sensor. For example, the touch value detection module 181 may perform the function to detect that a user touch is performed in response to the touch value being changed from OFF to ON, and may perform the function to detect that the user touch is terminated in response to the touch value being changed from ON to OFF.

The acceleration value detection module 182 may perform a function to calculate an offset for the gravitational acceleration from the acceleration sensor signal acquired through the acceleration sensor, reflect the calculated offset to the acceleration sensor signal, and detect an acceleration value by calculating an absolute value of the offset-reflected acceleration sensor signal.

The beat/non-beat determination module 183 may perform a function to determine whether or not a beat on a corresponding pad is performed based on the touch value detected in the touch value detection module 181 and the acceleration value detected through the acceleration value detection module 182.

For example, the beat/non-beat determination module 183 may perform a function to determine that the beat on the corresponding pad is performed in response to the user touch for the corresponding pad being detected through change of the touch value from OFF to ON and being detected that an intensity of the user touch corresponding to the acceleration value is more than or equal to a preset threshold value.

The sound output and mixing module 184 may perform a function to output a sound set to the corresponding pad in response to being determined that the beat on the corresponding pad is performed through the beat/non-beat determination module 183. In response to being determined that the beat on a plurality of pads 110 is performed, the sound output and mixing module 184 may perform a function to individually output sounds set to the pads or output a mixed sound by mixing the sounds set to the pads.

The communication module 185 is configured to perform communication with an external apparatus. The communication module 185 may include a device module used for communication with an external apparatus, a messaging module such as messenger program, short message service (SMS) and multimedia message service (MMS) program, or e-mail program, a call information aggregator program module, voice over internet protocol (VoIP) module, and the like.

The plurality of pads 110 provided in the electronic apparatus 100' may be implemented with one pad. For example, in response to the plurality of pads 110 being implemented with one pad, the one pad may be divided into a plurality of regions, and different channels may be matched to the divided regions.

FIG. 19 illustrates an exemplary embodiment that one pad is divided into the plurality of regions, but this describes a scratching operation. Even as in FIG. 19, the electronic apparatus 100 may include a plurality of pads.

However, the plurality of pads may be integrated with one pad and the one pad may be divided into the plurality of region, and thus a structure, a size, a thickness, and the like of the electronic apparatus 100 may be changed.

Because the different channels may be matched to the regions, a plurality of sounds may be set to the regions, and thus the user may beat the regions divided in the one pad other than the plurality pads, and the processor 140 may detect whether or not beats on the regions are performed by detecting the user touch and touch intensity through the acceleration sensor and the touch sensor provided in each region and individually output or mixedly output the sounds set to the regions according to the determination result.

Figure 25:
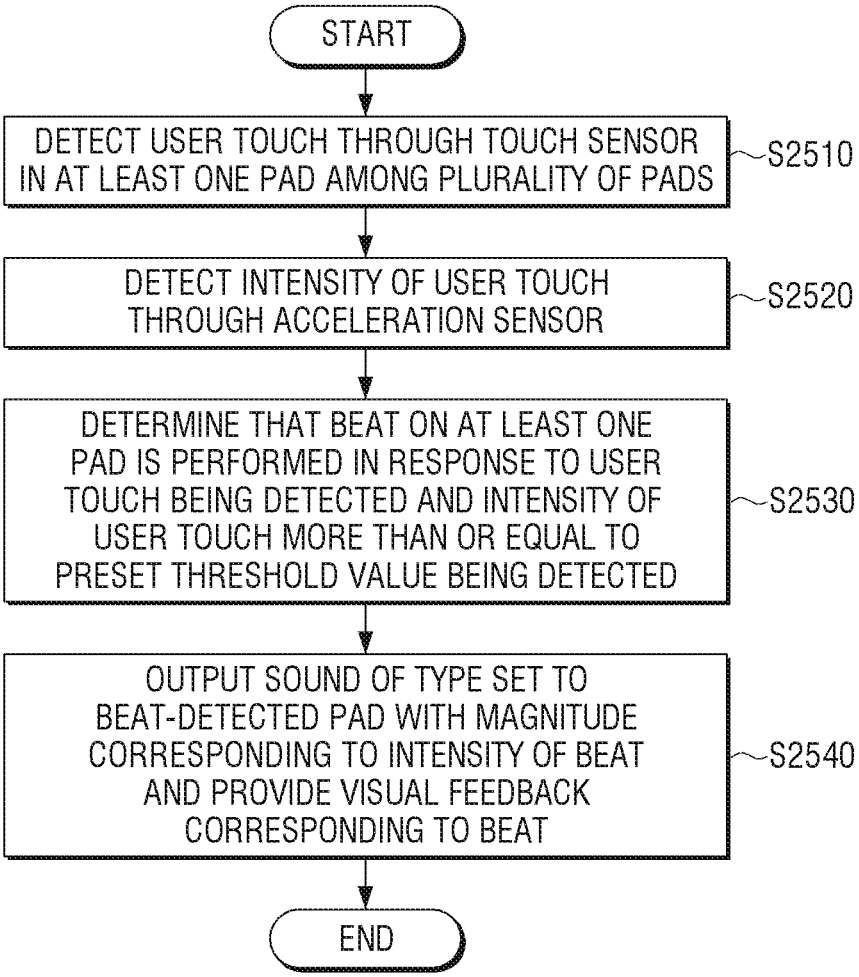
FIG. 25 is a flowchart illustrating a control method of an electronic apparatus according to an exemplary embodiment.

FIG. 25 is a flowchart illustrating a control method of an electronic apparatus according to an exemplary embodiment.

Referring to FIG. 25, the control method of an electronic apparatus including a plurality of pad, each pad including an acceleration sensor and a touch sensor, and a sound output interface configured to output a plurality of sounds set according to the plurality of pads includes detecting a user touch through the touch sensor in at least one pad among the plurality of pads (S2510).

The control method includes detecting an intensity of the user touch through the acceleration sensor (S2520).

The detecting of the user touch may include detecting the user touch based on change of a touch value corresponding to a touch sensor signal, and the detecting of the intensity of the user touch may include detecting the intensity of the user touch based on an acceleration value calculated from an acceleration sensor signal.

In response to the user touch being detected and the intensity of the user touch that is more than or equal to a preset threshold value being detected, the control method includes determining that the beat on the at least one pad is performed (S2530).

The determining may include determining that the beat is performed on a pad of which the touch value is ON and the acceleration value is more than or equal to the preset threshold value among the plurality of pads.

The determining may include determining that the beat is not performed on a pad of which the touch value is OFF or the acceleration value is less than the preset threshold value among the plurality of pads.

The plurality of pads may include a first pad and a second pad. The determining may include determining that a beat for the first pad is performed and determining an intensity of the user touch based on a first acceleration value in response to a first touch value detected through the first pad being ON and the first acceleration value detected through the first pad being more than or equal to the preset threshold value, and determining that a beat for a second pad is not performed in response to a second touch value detected through the second pad being OFF or a second acceleration value detected through the second pad being less than the preset threshold value.

The detecting of the intensity of the user touch may include compensating an offset for gravitational acceleration with respect to the acceleration sensor signal, and calculating the acceleration value based on the offset-compensated acceleration sensor signal.

The offset for the gravitational acceleration may be changed according to a slope of the electronic apparatus.

The method includes outputting the sound of a type set to the beat-detected pad with a magnitude corresponding to an intensity of a beat and providing visual feedback corresponding to the beat (S2540).

The providing may include providing the sound of the type set to the beat-detected pad and the visual feedback corresponding to the beat by differently determining a level of the sound and the visual feedback based on the intensity of the beat.

In addition, the exemplary embodiments may also be implemented through computer-readable code and/or instructions on a medium, e.g., a computer-readable medium, to control at least one processing element to implement any above-described embodiments. The medium may correspond to any medium or media that may serve as a storage and/or perform transmission of the computer-readable code.

The computer-readable code may be recorded and/or transferred on a medium in a variety of ways, and examples of the medium include recording media, such as magnetic storage media (e.g., ROM, floppy disks, hard disks, etc.) and optical recording media (e.g., compact disc read only memories (CD-ROMs) or digital versatile discs (DVDs)), and transmission media such as Internet transmission media. Thus, the medium may have a structure suitable for storing or carrying a signal or information, such as a device carrying a bitstream according to one or more exemplary embodiments. The medium may also be on a distributed network, so that the computer-readable code is stored and/or transferred on the medium and executed in a distributed fashion. Furthermore, the processing element may include a processor or a computer processor, and the processing element may be distributed and/or included in a single device.

The foregoing exemplary embodiments are examples and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. An electronic apparatus comprising:

a plurality of pads, each of the plurality of pads comprising a touch sensor and an acceleration sensor;

a sound output interface;

a display; and a processor configured to:

in response to a touch being detected by a touch sensor in one pad among the plurality of pads, and an intensity of the touch that is detected by an acceleration sensor in the one pad being greater than or equal to a threshold value, determine that a beat is performed on the one pad among the plurality of pads;

in response to the touch not being detected by the touch sensor in the one pad, or in response to the intensity of the touch that is detected by the acceleration sensor in the one pad being less than the threshold value, determine that the beat is not performed on the one pad;

in response to determining that the beat is performed on the one pad, control the sound output interface to output a sound that is set to the one pad, with a magnitude corresponding to an intensity of the beat; and control the display to display a visual feedback corresponding to the beat.

2. The electronic apparatus as claimed in claim 1, wherein the processor is further configured to:

detect the touch based on a change of a touch value of a touch sensor signal that is received from the touch sensor; and detect the intensity of the touch based on an acceleration value that is determined based on an acceleration sensor signal that is received from the acceleration sensor.

3. The electronic apparatus as claimed in claim 2, wherein the processor is further configured to determine that the beat is performed on the one pad of which the touch value is ON and the acceleration value is greater than or equal to the threshold value.

4. The electronic apparatus as claimed in claim 2, wherein the processor is further configured to determine that the beat is not performed on the one pad of which the touch value is OFF or the acceleration value is less than the threshold value.

5. The electronic apparatus as claimed in claim 2, wherein the processor is further configured to:

compensate the acceleration sensor signal with an offset for gravitational acceleration; and determine the acceleration value based on the compensated acceleration sensor signal.

6. The electronic apparatus as claimed in claim 5, wherein the processor is further configured to determine the offset for the gravitational acceleration based on a slope of the electronic apparatus.

7. The electronic apparatus as claimed in claim 1, wherein the plurality of pads comprise a first pad and a second pad, and the processor is further configured to:

detect a first touch value of a first touch sensor signal that is received from a first touch sensor in the first pad;

detect a first acceleration value that is determined based on a first acceleration sensor signal that is received from a first acceleration sensor in the first pad;

determine that a first beat is performed on the first pad of which the first touch value is ON and the first acceleration value is greater than or equal to the threshold value;

detect a second touch value of a second touch sensor signal that is received from a second touch sensor in the second pad;

detect a second acceleration value that is determined based on a second acceleration sensor signal that is received from a second acceleration sensor in the second pad; and determine that a second beat is not performed on the second pad of which the second touch value is OFF or the second acceleration value is less than the threshold value.

8. The electronic apparatus as claimed in claim 1, wherein the processor is further configured to control the display to display the visual feedback at a level corresponding to the intensity of the beat determined to be performed.

9. The electronic apparatus as claimed in claim 1, wherein the display comprises a light emitting diode (LED) corresponding to the one pad, and the processor is further configured to:

turn on the LED corresponding to the one pad on which the beat is determined to be performed; and adjust at least one among a brightness and a color of the LED based on the intensity of the beat determined to be performed.

10. The electronic apparatus as claimed in claim 1, further comprising an input interface configured to receive sound content from an external source, wherein the processor is further configured to:

mix the sound content and the sound that is set to the one pad on which the beat is determined to be performed, to generate a mixed sound; and control the sound output interface to output the mixed sound.

11. The electronic apparatus as claimed in claim 10, wherein the processor is further configured to control the display to display the visual feedback based on information of the sound content and the intensity of the beat determined to be performed.

12. The electronic apparatus as claimed in claim 1, further comprising an input interface configured to receive sound content from an external source, wherein the processor is further configured to:

in a first mode, mix the sound content and the sound that is set to the one pad on which the beat is determined to be performed, to generate a mixed sound, and control the sound output interface to output the mixed sound; and in a second mode, control the sound output interface to output the sound content other than the sound that is set to the one pad on which the beat is determined to be performed.

13. A method of controlling an electronic apparatus comprising a plurality of pads, each of the plurality of pads comprising a touch sensor and an acceleration sensor, and a sound output interface, the method comprising:

detecting a touch of one pad among the plurality of pads through a touch sensor in the one pad;

detecting an intensity of the touch through an acceleration sensor in the one pad;

determining that a beat is performed on the one pad in response to the touch of the one pad being detected, and the intensity of the touch detected by the acceleration sensor in the one pad being greater than or equal to a threshold value;

determining that the beat is not performed on the one pad in response to the touch not being detected by the touch sensor in the one pad, or in response to the intensity of the touch detected by the acceleration sensor in the one pad being less than the threshold value being; and outputting a sound that is set to the one pad, with a magnitude corresponding to an intensity of the beat, and displaying a visual feedback corresponding to the beat, in response to determining that the beat is performed on the one pad.

14. The method as claimed in claim 13, wherein the detecting the touch comprises detecting the touch based on a change of a touch value of a touch sensor signal that is received from the touch sensor, and the detecting the intensity of the touch comprises detecting the intensity of the touch based on an acceleration value that is determined based on an acceleration sensor signal that is received from the acceleration sensor.

15. The method as claimed in claim 14, wherein the determining that the beat is performed comprises determining that the beat is performed on the one pad of which the touch value is ON and the acceleration value is greater than or equal to the threshold value.

16. The method as claimed in claim 14, wherein the determining that the beat is performed comprises determining that the beat is not performed on the one pad of which the touch value is OFF or the acceleration value is less than the threshold value.

17. The method as claimed in claim 14, further comprising:

compensating the acceleration sensor signal with an offset for gravitational acceleration; and determining the acceleration value based on the compensated acceleration sensor signal.

18. The method as claimed in claim 17, further comprising determining the offset for the gravitational acceleration based on a slope of the electronic apparatus.

19. The method as claimed in claim 13, wherein the plurality of pads comprise a first pad and a second pad, and the method further comprises:

detecting a first touch value of a first touch sensor signal that is received from a first touch sensor in the first pad;

detecting a first acceleration value that is determined based on a first acceleration sensor signal that is received from a first acceleration sensor in the first pad;

determining that a first beat is performed on the first pad of which the first touch value is ON and the first acceleration value is greater than or equal to the threshold value;

detecting a second touch value of a second touch sensor signal that is received from a second touch sensor in the second pad;

detecting a second acceleration value that is determined based on a second acceleration sensor signal that is received from a second acceleration sensor in the second pad; and determining that a second beat is not performed on the second pad of which the second touch value is OFF or the second acceleration value is less than the threshold value.

20. The method as claimed in claim 13, wherein the displaying comprises displaying the visual feedback at a level corresponding to the intensity of the beat.

* * * * *